US005771665A

United States Patent [19]

Nelson et al.

[11] Patent Number: 5,771,665

[45] Date of Patent: Jun. 30, 1998

[54] SAND BAGGING SYSTEM

[76] Inventors: W. Titus Nelson; Gary Leeman, both of 16449 53rd Pl. S., Tukwila, Wash. 98188

[21] Appl. No.: 763,336

[22] Filed: Dec. 11, 1996

Related U.S. Application Data

[60] Provisional application No. 60/009,091 Dec. 12, 1995.

[51] Int. Cl.[6] ..... B65B 1/16; B65B 43/14; B65B 43/26; B65B 43/54

[52] U.S. Cl. ..... 53/459; 53/468; 53/469; 53/284.7; 53/570; 53/573; 141/10; 141/114

[58] Field of Search ..... 53/468, 469, 570, 53/573, 503, 384.1, 284.7; 141/10, 114

[56] References Cited

U.S. PATENT DOCUMENTS

| | | | |
|---|---|---|---|
| 3,382,644 | 5/1968 | Vogt | 53/469 X |
| 3,599,388 | 8/1971 | Feingold | 53/570 X |
| 3,830,266 | 8/1974 | Hudson | 141/10 |
| 3,908,343 | 9/1975 | Farrelly | 53/570 X |
| 3,956,866 | 5/1976 | Lattur | 53/469 X |
| 4,054,161 | 10/1977 | Alack | 141/12 |
| 4,172,349 | 10/1979 | Lipes | 53/459 |
| 4,174,599 | 11/1979 | Callet et al. | 53/512 |
| 4,182,094 | 1/1980 | Lieder et al. | 53/67 |
| 4,229,928 | 10/1980 | Munchinger et al. | 53/469 X |
| 4,291,517 | 9/1981 | Lipes | 53/573 X |
| 4,300,600 | 11/1981 | Tetenborg et al. | 141/10 |
| 4,381,545 | 4/1983 | Biddle, III et al. | 364/479 |
| 4,519,426 | 5/1985 | Hardy, Jr. | 141/5 |
| 4,548,826 | 10/1985 | Watkins | 53/469 X |
| 4,558,556 | 12/1985 | Jostler | 53/469 X |
| 4,703,782 | 11/1987 | Henkel, Sr. | 141/65 |
| 4,805,673 | 2/1989 | Wohrle et al. | 141/10 |
| 4,944,334 | 7/1990 | McGregor | 141/71 |
| 4,945,713 | 8/1990 | Widenback | 53/469 X |
| 5,154,271 | 10/1992 | Binzen | 193/30 |
| 5,215,127 | 6/1993 | Bergeron | 141/10 |
| 5,327,947 | 7/1994 | McGregor | 141/71 |
| 5,551,215 | 9/1996 | McDonald et al. | 53/570 X |

OTHER PUBLICATIONS

"Increasing Efficiency in a Sandbagging Operation," by George F. Turk et al., The REMR Bulletin, Vo. 11,, No. 2, Jul. 1994.

"New Sandbagging Machine Can Fill Over 86,000 Sandbags a Day," Seattle Daily Journal of Commerce, vol. 102, No. 278, Nov. 30, 1995.

*Primary Examiner*—Horace M. Culver
*Attorney, Agent, or Firm*—Delbert J. Barnard

[57] ABSTRACT

A sand bagging system is adapted to fill and seal a multiplicity of sand bags in a rapid fashion. Bags are extracted from a cassette of interconnected bags, positioned at a charge station. At the charging station, a charge of bulk material is collected and discharged into the bag, which is subsequently closed and discharged. The sand bagging system is particularly adapted to be used during emergency flooding situations.

29 Claims, 25 Drawing Sheets

FIG. 23B
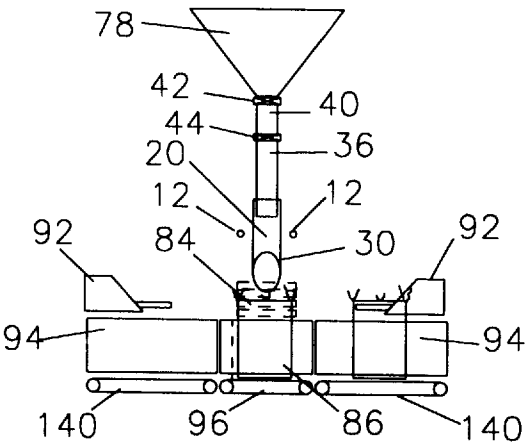
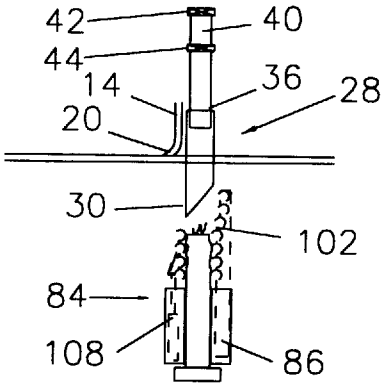
FIG. 23A
FIG. 22B
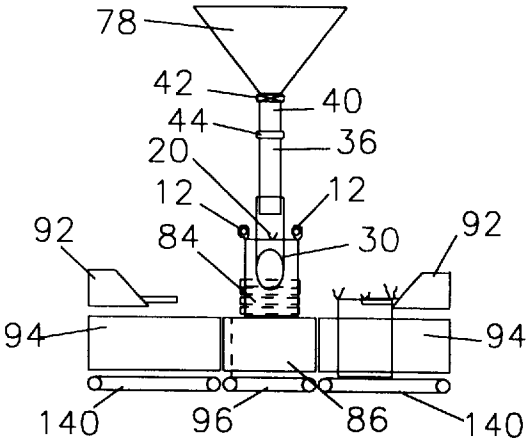
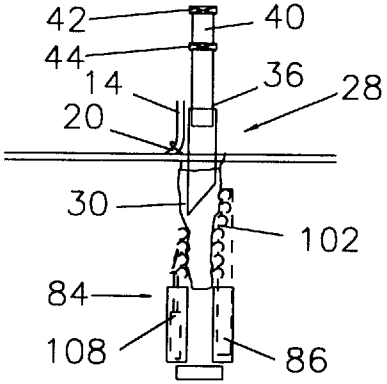
FIG. 22A

SAND BAGGING SYSTEM

CROSS-REFERENCE TO RELATED APPLICATION

This application is a continuation-in-part application of provisional application Ser. No. 60/009,091, filed Dec. 12, 1995, entitled, "Sand Bagging System."

FIELD OF THE INVENTION

This invention relates to dry material handling, and more particularly to the transfer of granular material into sand bags.

BACKGROUND OF THE INVENTION

The present invention is a sand bagging system that is adapted to fill and seal a multiplicity of sand bags in a rapid fashion. The sand bagging system is designed to be used during emergency flooding situations. It is common during such emergency flooding situations for people to manually shovel sand into sandbags for use in building retaining walls or dikes. Sandbagging often is accomplished without the convenience of extensive experience. The present invention is directed at reducing the amount of time it takes to fill and seal sandbags, and to reduce the workload of personnel charged with providing filled sandbags.

In various circumstances, including flood situations, it is necessary to fill a large number of sandbags in order that the filled sandbags may be placed as desired. Manual filling of sandbags takes over a minute per bag. After filling, the bags must be secured so that the sand does not exit the bag. The bags must be uniform and not overfilled, since overfilled bags leave gaps in retaining walls, are heavy, cumbersome to handle and stack, and may rupture. In addition, the tie causes the bag to bunch up, which reduces the effectiveness of the bag or reduces its effective capacity.

Filling the sand bags is also a difficult job, and consumes an inordinate amount of labor. There are cases in which the availability of filled bags is a limiting factor in encouraging the public to use sandbags.

The use of manual tying techniques reduces the utility of sandbags in that the bags are more easily recovered and distributed for their contents if they are uniform and not likely to open prematurely. If sandbags were more commercially suitable after their initial use, the cost of recovery of the used sandbags could be reduced.

Semi-automated sandbagging systems exist, which can speed up the process, but they generally require a person to manually hold the bag while sand is dumped into the bag in some type of mechanized manner. As a result, it often takes minutes to fill sandbags with sand. As is well understood, during emergency flooding situations, time is of the essence. The manual holding of the sandbags further does not assure uniform tying.

SUMMARY OF THE INVENTION

The present invention is directed at reducing the amount of time it takes to fill and seal sandbags. The invention is directed to a system for filling sand bags with sand. While the present invention was developed for the purpose of quickly filling bags with sand, it is believed that the present invention has general utility for filling bags with a variety of types of bulk material.

The sand bagging apparatus includes a set of rails, which support a plurality of sand bags in a cassette. The sand bags are held on the rails by tabs which are in turn attached to ribbons. The bags are withdrawn from the cassette by the ribbons.

Each sand bag is filled by a fill tube which moves downwardly into the sand bag. After each sand bag is loaded with sand, the fill tube is raised, and a set of cutters sever the tabs. The filled sand bag is then discharged laterally to a sewing station. After being sewn shut, the sand bags are discharged from sand bagging apparatus.

DESCRIPTION OF THE DRAWINGS

FIGS. 16–27 are a series of views illustrating operation of the sand bagging system of FIG. 15. Each FIG. 16*a* through 27*a* is a front view of the system, and each FIG. 16*b* through 27*b* is a corresponding side view of the bag former and charging device;

DETAILED DESCRIPTION OF THE INVENTION

Figure 1:
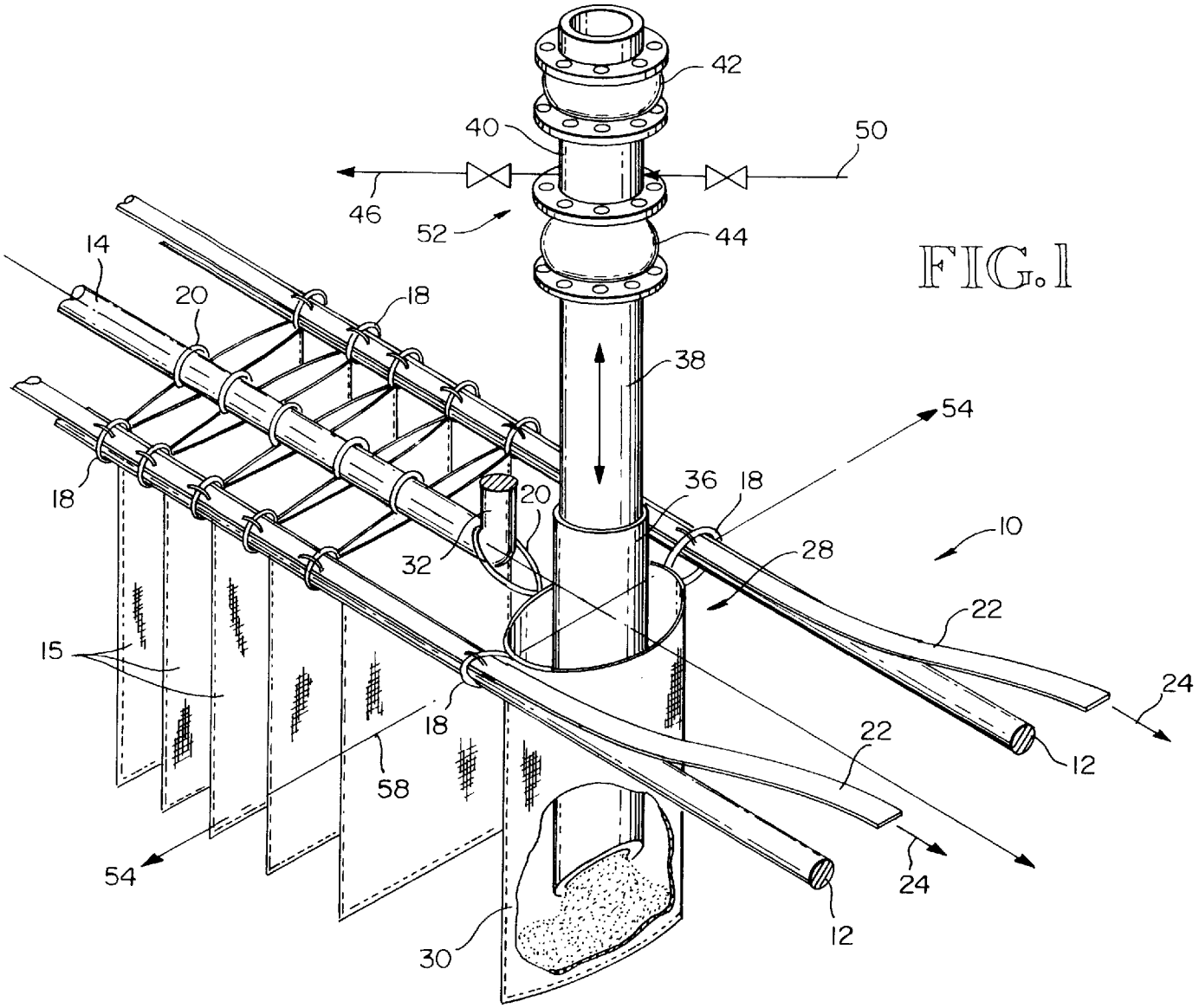
FIG. 1 is a partial pictorial view of the sand bagging system of the present invention.
Figure 3A:
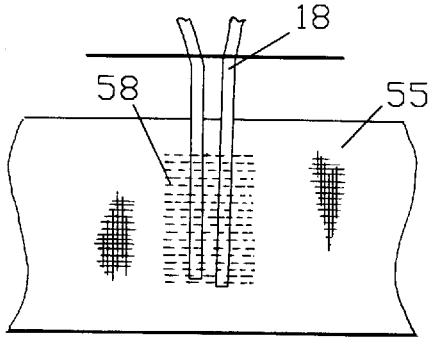

Referring to FIG. 1, the preferred embodiment of the present invention is applied for filling sand bags with sand.

While the present invention was developed for the purpose of quickly filling woven bags with sand, the present invention has general utility for filling bags with a variety of types of bulk material.

As shown in FIG. 1, the sand bagging apparatus 10 includes a set of three rails, a pair of outer bag rails 12 and a center rail 14. The rails 12, 14 support a plurality of sand bags 15 in a cassette 16. Sand bags 15 in the cassettes 16 are held on rails 12, 14 by a pair of outer tabs 18 and a center tab 20. Outer tabs 18 are attached to a pair of ribbons 22, which each ride on outer bag rails 12. A pair of ribbon-tensioning devices (not shown) provide tension on ribbons 22 in the direction indicated by arrows 24. The tension on ribbons 22 serves to advance and open sand bags 15 from a cassette of bags 16 to a charging station 28.

At charging station 28, a sand bag 30 is held in an open position primarily by an upturned end 32 of center rail 14.

Center tab 20 of bag 30 is held on center rail 14 by upturned end 32, while outer tabs 18 are pulled by ribbons 22 in the direction indicated by arrows 24. This causes sand bag 30 to open in the shape of a triangle.

With the sand bag 30 in an open position, a fill tube 36 moves downwardly, in a telescoping manner, along a stationary charge tube 38 into sand bag 30. In this position, a charge of sand is released from a charge chamber 40 down charge tube 38 and fill tube 36 into sand bag 30. Charge chamber 40 includes a hopper valve 42 and a fill valve 44, placed in series in charge tube 38, to measure a selective charge of sand for loading into sand bag 30. A vacuum line 46 functions to evacuate chamber 40 with hopper valve 42 in a closed position. A supply of sand is provided above hopper valve 42.

In a first embodiment, a compressed air source 50 functions to force a measured charge of sand from chamber 40 down charge tube 38 and into sand bag 30. The design and operation of what can collectively be referred to as the charging assembly 52 will be discussed in more detail later.

After a sand bag 30 is loaded with sand, fill tube 36 is raised, fill valve 44 is closed, and a set of cutter devices (not shown) are operated to sever tabs 18 and 20, which frees sand bag 30 of rails 12, 14 and allows sand bag 30 to be discharged laterally, in the direction indicated by arrows 54, to a sewing station (not shown), to seal the top edges of the sand bag.

Figure 2A:
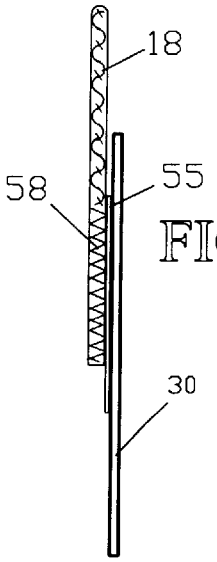
FIGS. 2–4 illustrate the manner of securing tabs to the top open edge of the sand bags.
Figure 2:
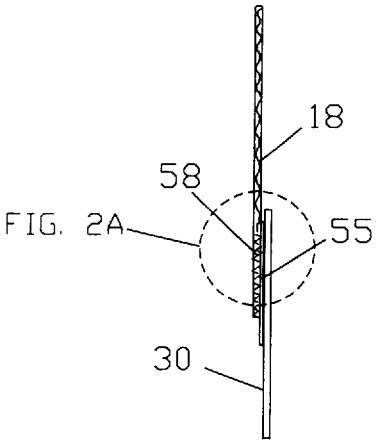
Figure 3:
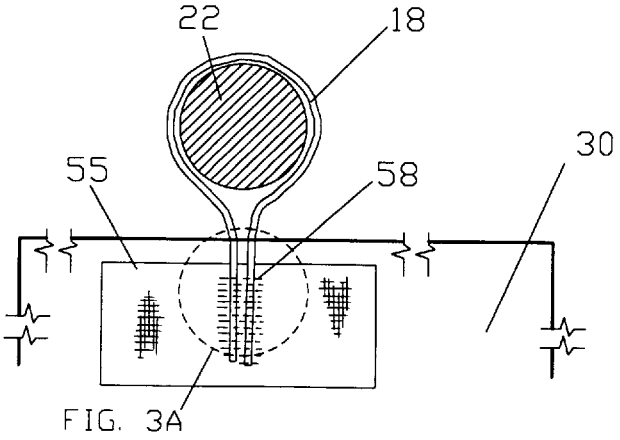
Figure 4:
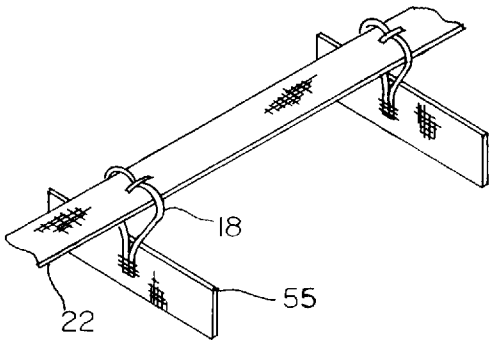

In FIGS. 2–4, tabs 18 are shown attached to blanks 55 by cross-stitching 58. The blanks 35 are, in turn, sewn into the bags 30. Tabs 18 also are secured to the tension ribbons, either by stitching or adhesive. Preferably, a cassette of bags is manufactured, with their bag tabs 18, 30 sewn or adhered to the ribbons 22 in a spaced-apart manner. The center tabs 20 are also attached to the blanks 55 by this process of stitching.

Figure 5:
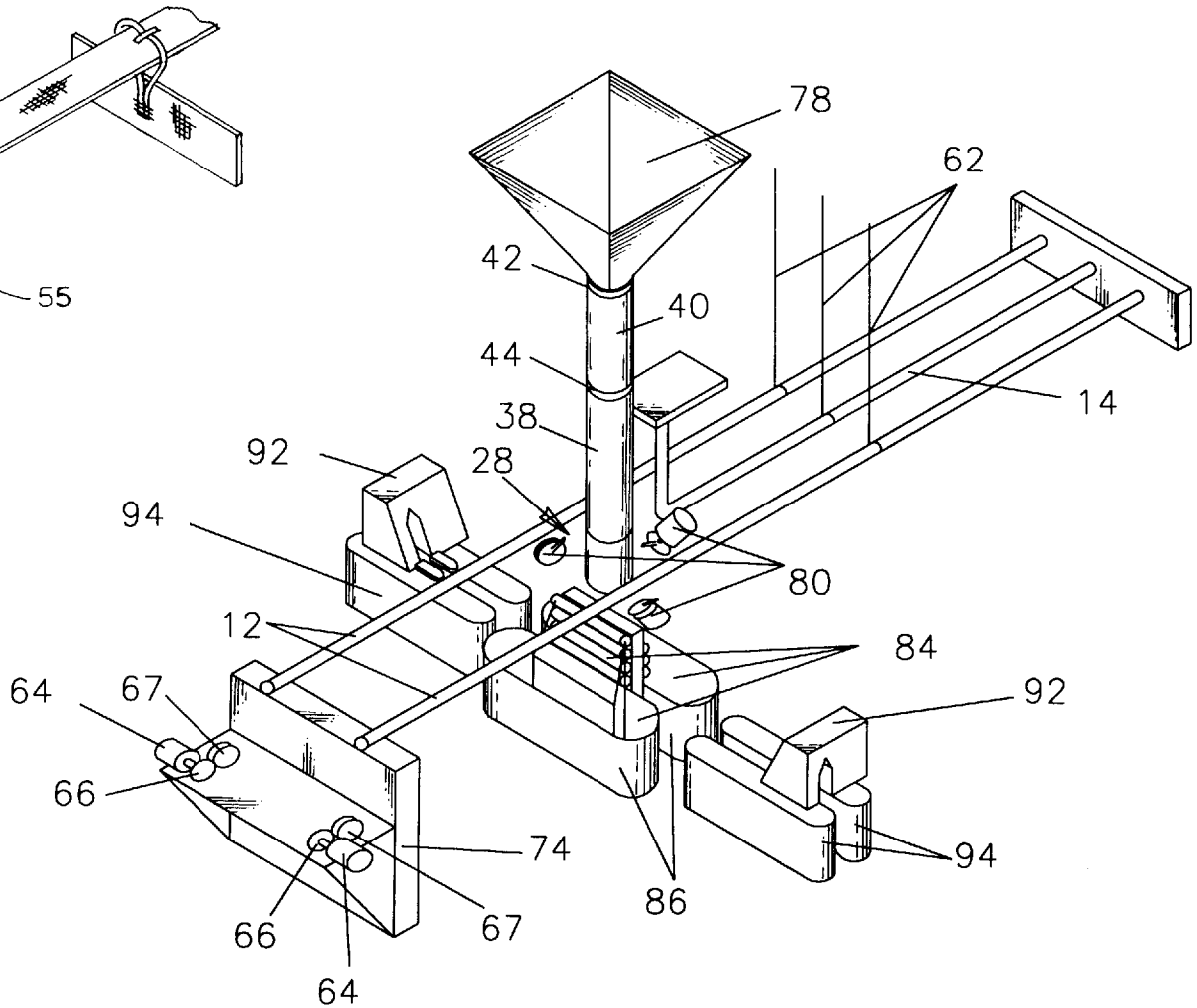
FIG. 5 is a schematic pictorial view of the sand bagging system of FIG. 1.

Referring to FIG. 5, the sand bagging apparatus 10 of FIG. 1 is shown schematically in more detail. Rails 12, 14 are held in position by temporary rail supports 62. Rail supports 62 can be removed to allow for the restocking of a new bag cassette. Ribbon take-up motors 64 rotate wheels 66, and thus wheels 67, to tension the ribbon (not shown), to provide advancement of the sand bags. A support piece 74 carries the outer ends of bag rails 12.

A vacuum system hopper 78 is shown mounted above charge chamber 40. Hopper 78 receives a supply of sand, from which a charge is withdrawn into chamber 40 for loading into individual sand bags.

A set of three tab cutters 80 are positioned at charging station 28 adjacent their respective rails 12, 14. Tab cutters are either an Airfly cutter or Servo cutter manufactured by Extrusion Services, Inc., Akron, Ohio, U.S.A. After a sand bag is loaded with sand, cutters 80 are operated to sever the tabs holding the sand bags. As an alternate method tabs 18 may be sized such that the weight of sand discharged to the bag breaks the tabs 18 without using cutters.

Beneath charging station 28 is a bag-forming apparatus 84. Bag-forming apparatus 84 includes a pair of vertical side conveyor belts 86 and a bottom conveyor belt (not shown) between conveyor belts 86. Conveyor belts 86 operate to discharge a filled sand bag laterally toward either one of a pair of sewing machines 92. Each sewing machine 92 has associated with it a pair of vertical side conveyor belts 94 and a bottom conveyor belt (140, shown in FIG. 9). Sand bags are alternately discharged from bag former 84 to sewing machines 92. Each sewing machine sews the upper edges of a sand bag and then discharges the sewn sand bag laterally from sand bagging apparatus 10.

Figure 6:
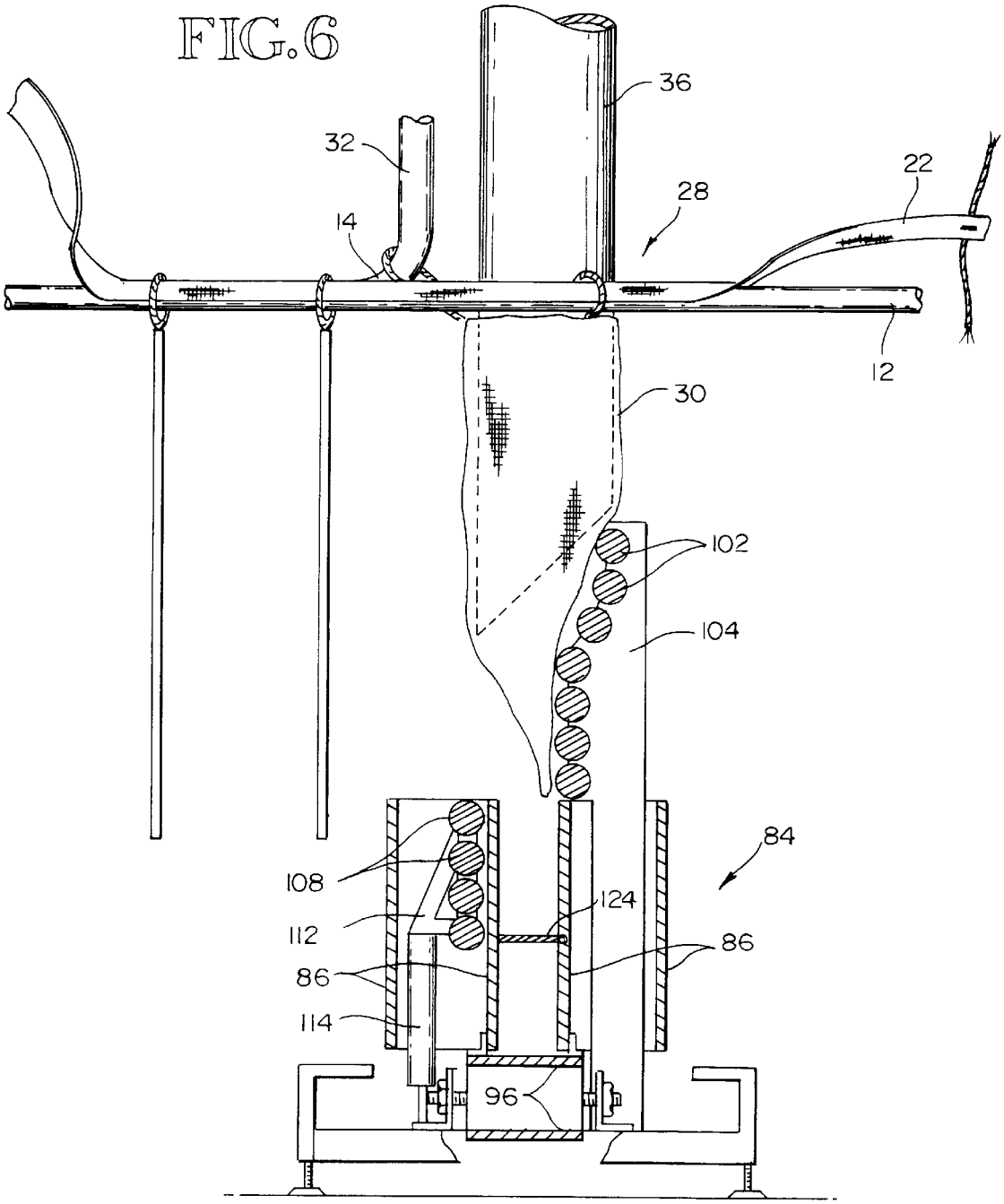
FIG. 6 is a side view of a sand bag in position, prior to being filled with sand.

FIG. 6 illustrates bag former 84 in more detail. Bag former 84 includes a pair of vertical side conveyor belts 86 and a bottom horizontal conveyor belt 96. Conveyor belts 86, 96 receive between them a sand bag and, in a sense, form the sand bag as it fills with sand, and then discharge the sand bag laterally from bag former 84. Bag former 84 also includes a plurality of rollers 102 positioned in an arcuate path above conveyor belts 86. Rollers 102 are rotatably supported on an upright post 104, which is secured to the base of bag former 84. Post 104 extends upwardly through or between conveyor belt 86'. A secondary set of rollers 108 are rotatably supported on a support bracket 112, which, in turn, is mounted to a first actuator cylinder 114. Actuator cylinder 114 operates to raise and lower rollers 108 from a position within conveyor belt 86 to a position above conveyor belt 86 and opposing rollers 102.

In operation, sand bag 30 is moved into charging station 28 by tension ribbons 22. Upturned end 32 of center rail 14 opens sand bag 30, whereupon fill tube 36 inserts into sand bag 30.

As shown in FIG. 6, a bottom plate 124 is provided. The bottom plate 124 provides a downward limit to the movement of the sand bag 30 as the sand bag 30 is filled with a charge of sand 132. After the charge of sand 132 is dumped into sand bag 30, and the cutter devices 80 (FIG. 5) sever tabs 18, 20. Actuator cylinder 114 is in an extended position to position rollers 108 to receive sand bag 30 and form it into an elongated narrow shape defined by the spacing between rollers 108, 102 and between conveyor belts 86, 86'.

Figure 7:
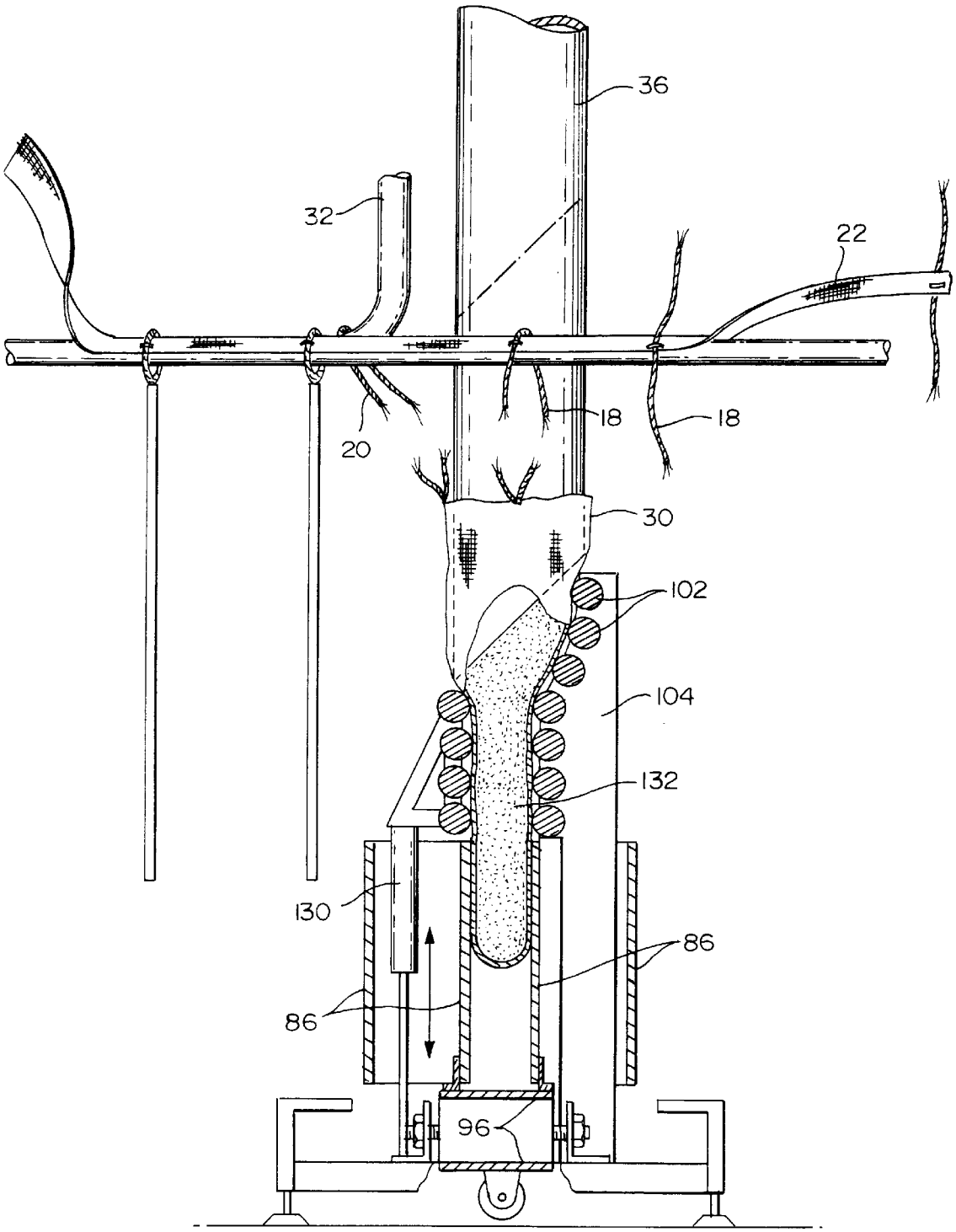
FIG. 7 is a side view like FIG. 6, with the sand bag breaking away and falling into a bag former.

The cutter devices 80 of FIG. 5 are optional, in that the tabs 18 or the attachment of the tabs 18 to the ribbons 22 may be such that the sandbags 30 will detach from the ribbons after being filled with the charge of sand 132. As shown in FIG. 7, after the sand bag 30 is filled with the charge of sand 132, the bottom plate 124 is retracted, allowing the bag 30 to drop to the bottom horizontal conveyor belt 96. It is possible to retract the bottom plate 124 before the cutter devices 80 have severed the tabs 18, but in the preferred embodiments, the bottom plate 124 supports the bags 18 until the tabs 18 are severed. In the case where the tabs 18 sever without the benefit of the cutter devices 80, the cutter bottom plate 124 would be removed before the bags reach the cutter devices if the cutter devices 80 are used at all.

Figure 8:
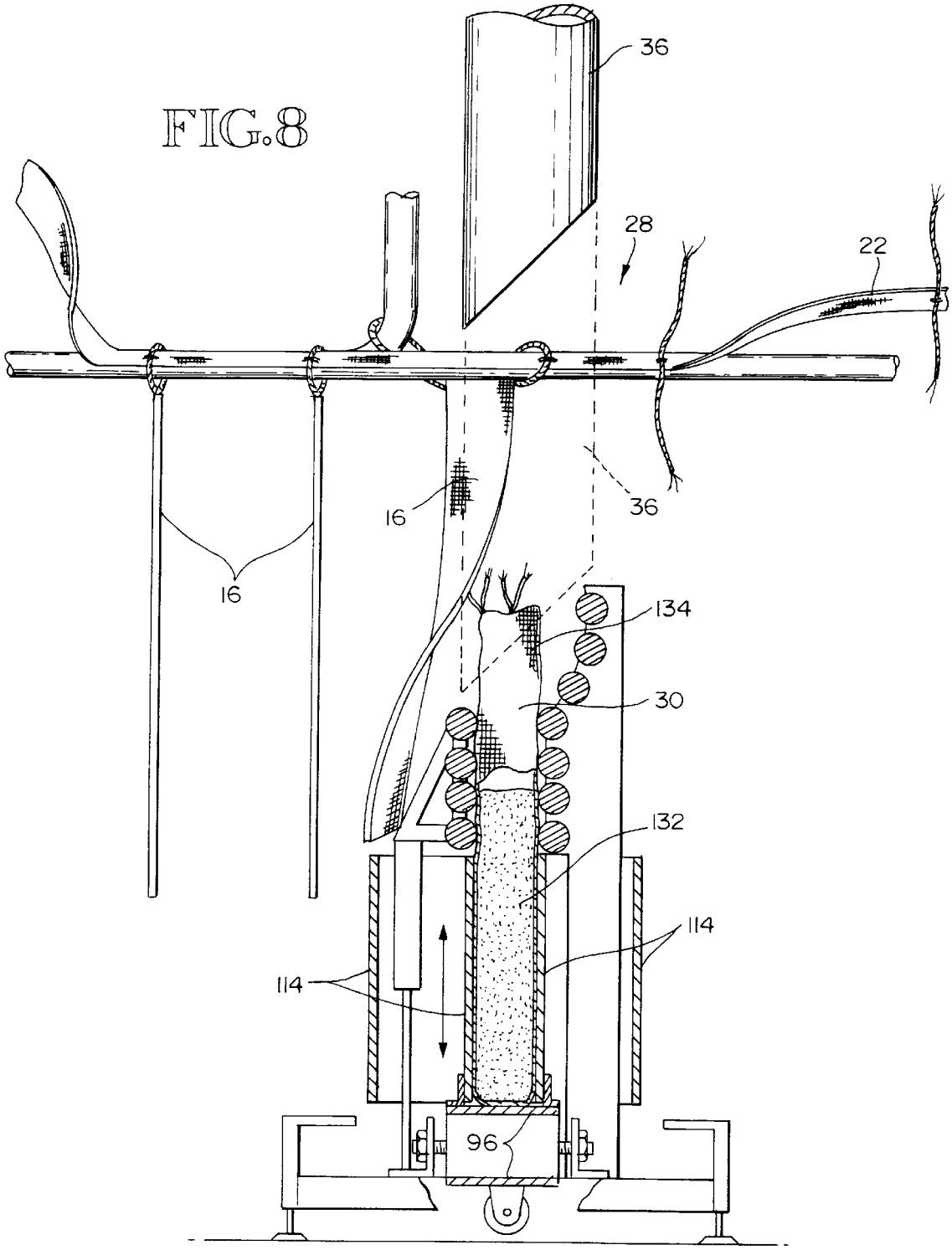
FIG. 8 is a view like FIG. 7 with the sand bag fully formed and supported by the bag former with a trailing bag being moved into position.

In FIG. 8, sand bag 30 has fallen onto bottom conveyor 96 and is completely formed into an upright narrow rectangular shape. With this shape, upper ends 134 of sand bag 30 can be captured and guided into the sewing components of the sewing machines. With sand bag 30 fully formed and ready to be laterally discharged, fill tube 36 is raised and the next sand bag 16 is advanced by ribbons 22 into charging station 28.

Figure 9A:
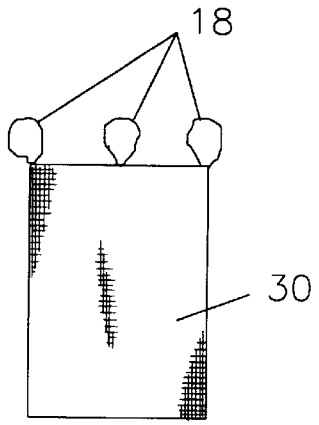
FIG. 9 is a schematic end view of the sand bagging system of FIG. 1, showing the discharge conveyors.
Figure 9:
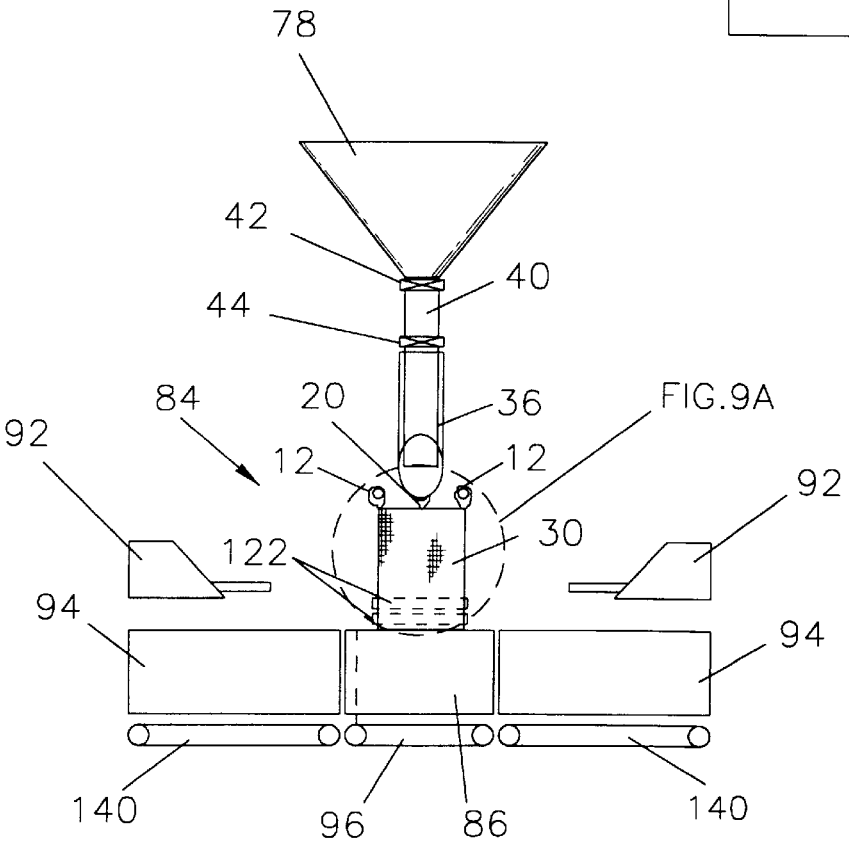

In FIG. 9, the coordinated operation of sewing machines 92 is illustrated in schematic form. Each sewing machine 92 is associated with the pair of upright conveyor belts 94 (also shown in FIG. 5) and a bottom conveyor belt 140. Each set of side conveyor belts 94 and bottom conveyor belt 140 operate to move a sand bag in a manner similar to side conveyor belts 86 and bottom conveyor belt 96 of bag former 84. Sand bag 30 shown in FIG. 9 is about to be opened. When the sand bag 30 is opened, fill chute 36 moves downwardly into the bag to dump a charge of sand. After the sand bag 30 is loaded with sand, its tabs 18, 20 are cut and the sand bag 30 falls onto bottom conveyor belt 96 between side conveyor belts 86. Conveyors 86, 96 are controlled to alternately discharge a filled sand bag to the right and then to the left to sewing machines 92. In this manner, operation of filling sand bags 30 can be accelerated to the point where the sand bags 30 are filled at the same rate that two sand bags 30 are sewn shut.

Figure 10:
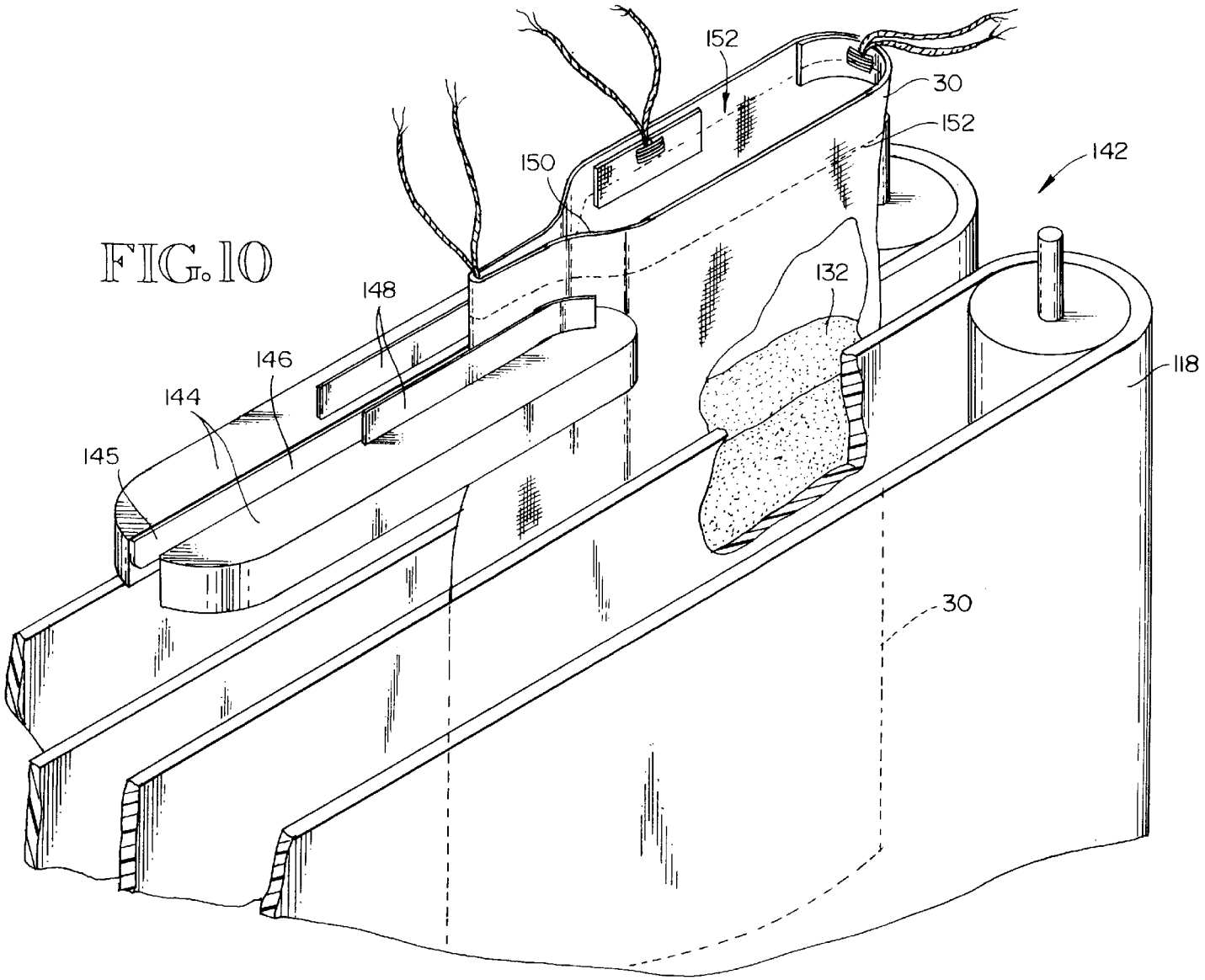
FIG. 10 is an enlarged pictorial view of a discharge conveyor and guide mechanism for aligning the top edges of a sand bag with a sewing machine.

In FIG. 10, sand bag 30 filled with a charge of sand 132 is moved laterally, in the direction of arrows 142, from the bag former (not shown), between side conveyor belts 94 and toward a pair of guide bars 144. At this point, the sand bag 30 is in an elongated upright, somewhat rectangular shape. Guide bars 144 define between them a slot region 146. A pair of guide rails 148 are mounted on guide bars 144. Guide bars 144 and guide rails 148 are positioned vertically at a height a few inches below the upper edges 150 of sand bag 30. Each guide bar 144 includes a drive belt 145. Belt 145 is synchronized with belt 118. Belt 145 has an inner run that captures the upper edges of bag 30 and moves bag 30 through slot region 146. As sand bag 30 moves between conveyor belts 94, the upper regions 152 of sand bag 30 move between guide rails 148 and guide bars 144 into slot region 146. This brings the upper portions 152 of sand bag 30 together in preparation of stitching the sand bag 30 closed.

Figure 11:
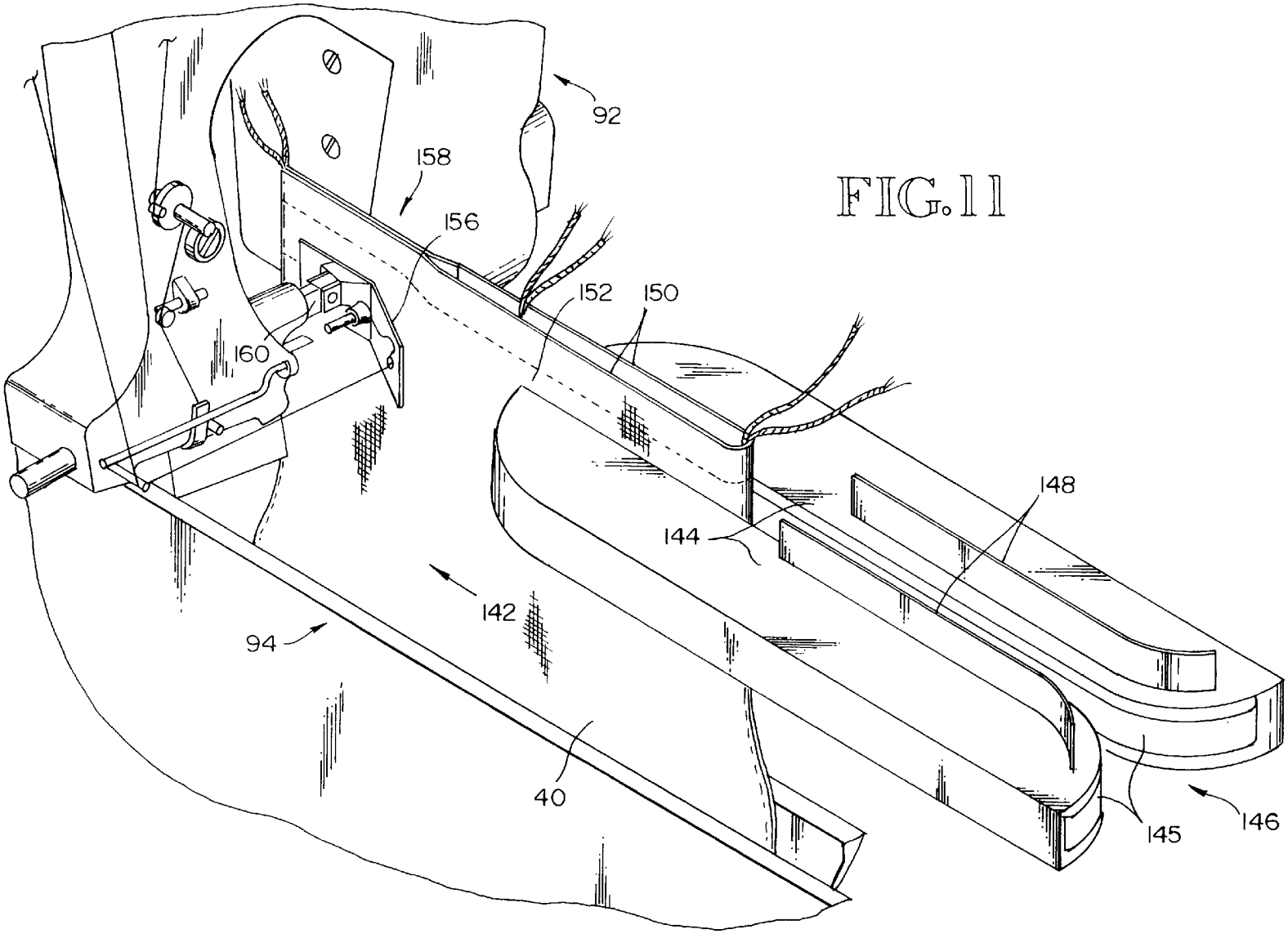
FIG. 11 is an enlarged pictorial view of a sewing machine sewing the top edges of a sand bag.

In FIG. 11, sewing machine 92 is positioned laterally outwardly of guide bars 144. Sewing machine 92 is a conventional industrial sewing machine, such as Model 80800RLZ26 Heavy Duty Sewing Head for plain closures, with US600 Double Headed Column with sewing motor and with GAS9905X1 Feed-In Device manufactured by Union Special Corporation, Huntley, Ill., U.S.A. Sewing machine 92 includes a presser foot 156, a work plate 158, and a needle bar 160. Conveyor belts 94 (FIG. 9) move sand bag 30 laterally outwardly in the direction of arrow 142, which brings the upper edge portions 152 of sand bag 30 between presser foot 156 and work plate 158. A simple lock stitch is made along the upper edge portions 152 of sand bag 30 to close the sand bag.

Figure 12:
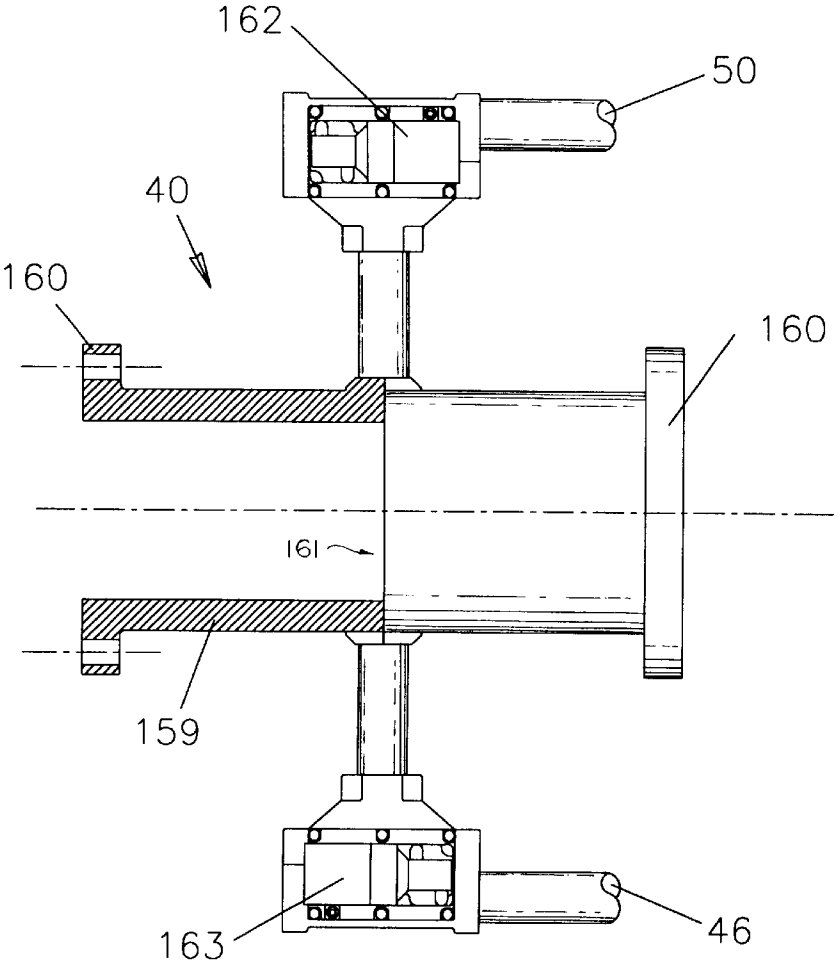
FIG. 12 is a schematic view of the compression/vacuum charge chamber of FIG. 1.

In FIG. 12, charge chamber 40 is shown in more detail. A tubular metal housing 159 with flanged ends 160 defines an interior cylindrical chamber 161. Compressed air line 50 leads from a source of compressed air (not shown) to a solenoid valve 162, which controls the flow of compressed air into chamber 161. Vacuum line 46 leads from a vacuum source (not shown) to a second solenoid valve 163, which controls the vacuum flow out of chamber 161. Charge chamber 40 is positioned between the hopper valve 42 and the fill valve 44 of the charge tube.

Figure 13:
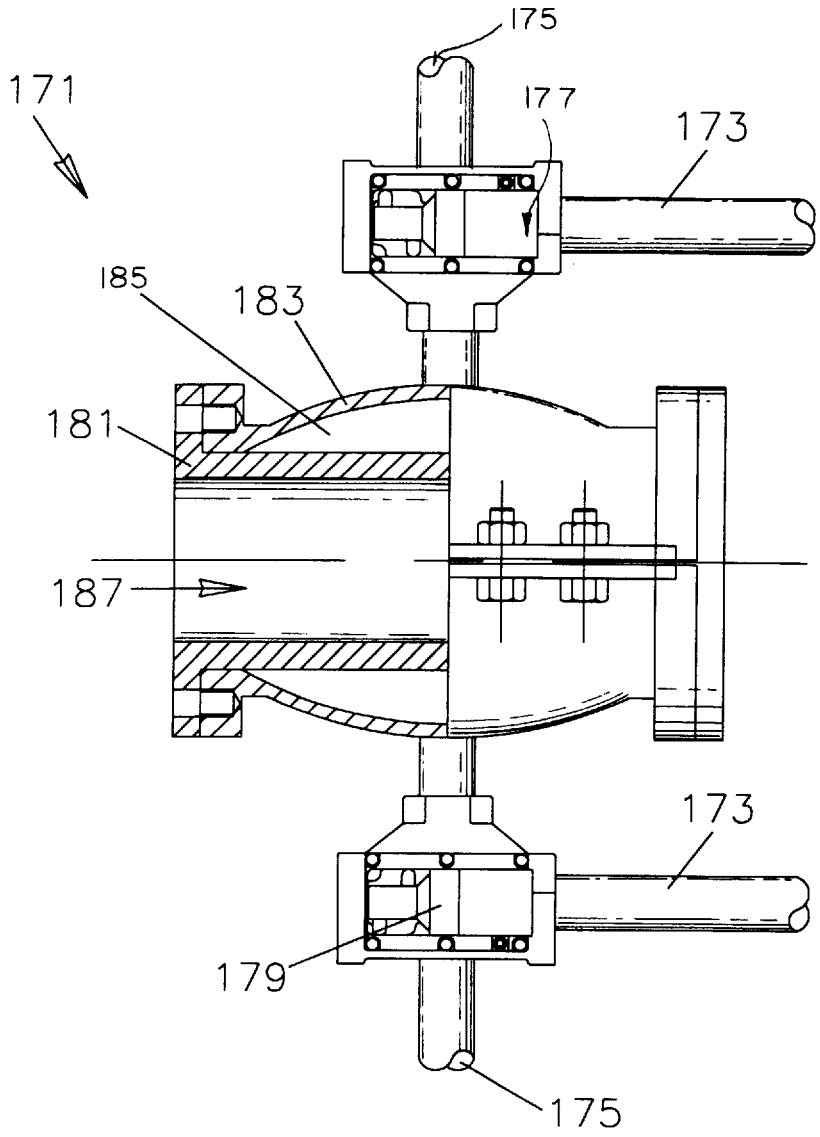
FIG. 13 is a schematic view of a modified pinch valve of the charge tube of FIG. 1.

FIG. 13 shows a modified pinch valve 171 that is used for the hopper valve and the fill valve for charging and discharging sand into the charge chamber. Pinch valve 171 is a modified Type "A" 6 inch diameter pinch valve manufactured by Red Valve Company, Carnegie, Pa., U.S.A. Pinch valve 171 is modified to include two inch air lines for compressed air line 173 and vacuum line 175. These larger air lines allow quicker introduction and evacuation of compressed air into and out of pinch valve 171.

A three-way solenoid pilot valve 177 controls compressed air lines 173 and vacuum line 175. Pinch valve 171 includes a flexible tubular wall 181 secured within an expanded outer wall 183. Between tubular wall 181 and outer wall 183 is an annular chamber 185, which are in fluid communication with air lines 173, 175. Tubular wall 181 constricts to close off passageway 187 upon introduction of compressed air into annular chamber 185. Evacuation of annular chamber 185 causes tubular wall 181 to expand, opening up passageway 187. Additional three-way pilot valve 179 is shown as an additional valve for compressed air 173 and vacuum 175 control.

Figure 14:
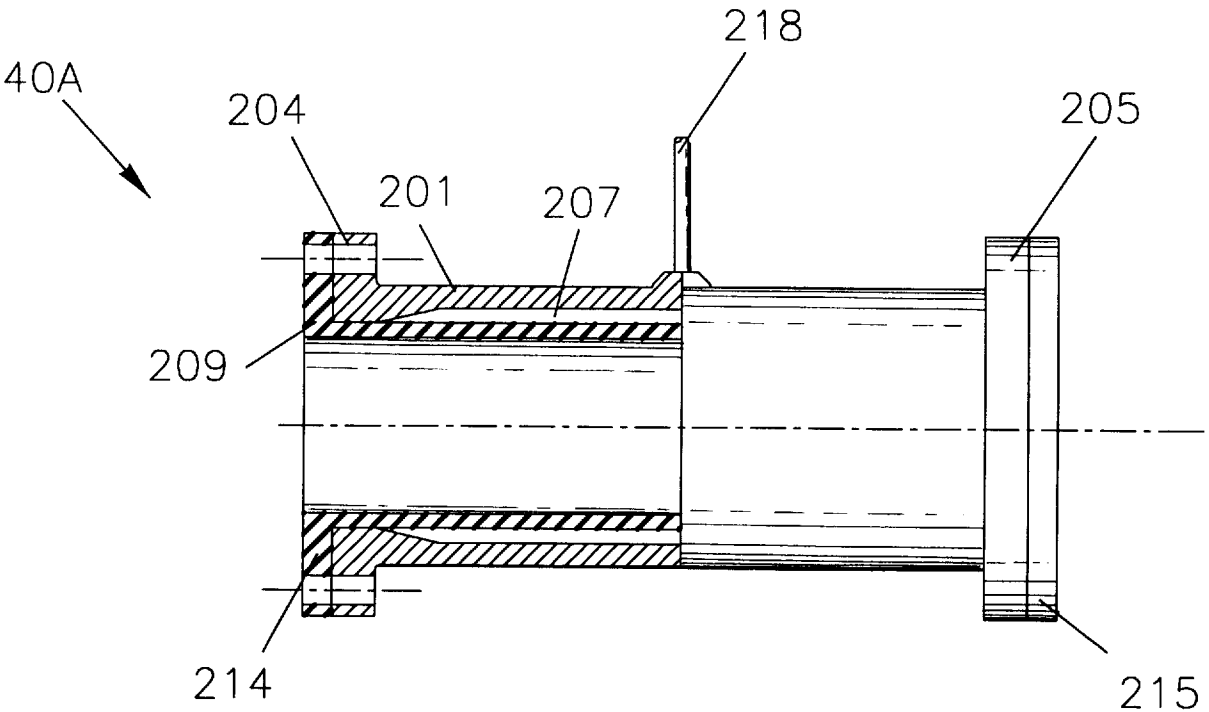
FIG. 14 is an enlarged view of a charge measuring tube for regulating the amount of sand in each sandbag.

FIG. 14 shows an optional variable volume metering section 40A that can replace charge chamber 40. The variable volume metering section 40A is provided with a housing 201 which has upper and lower flanges 204, 205. The housing 201 has an annular recessed region. An I-shaped rubber tube 209 is positioned within the housing 201, and the recessed region 207 forms a static air space. Rubber tube 209 includes upper flanges 214 and lower flanges 215. Flanges 204, 205 and flanges 214, 215 have aligned openings for receiving a fastener (not shown). A compressed air port 218 leads into annular recess 207 from a source of compressed air (not shown) Compressed air introduced into annular region 207, or evacuated therefrom, moves rubber tube 209 together or apart to vary the volume of the inner region defined by rubber tube 209. In this manner, the volume of bulk material loaded into each bag can be adjusted to accommodate bags of different sizes. Metering section 40A is believed to be especially suitable for bag loading systems that utilize variable bag sizes or fixed bags that can accommodate variable volumes of product.

Figure 15:
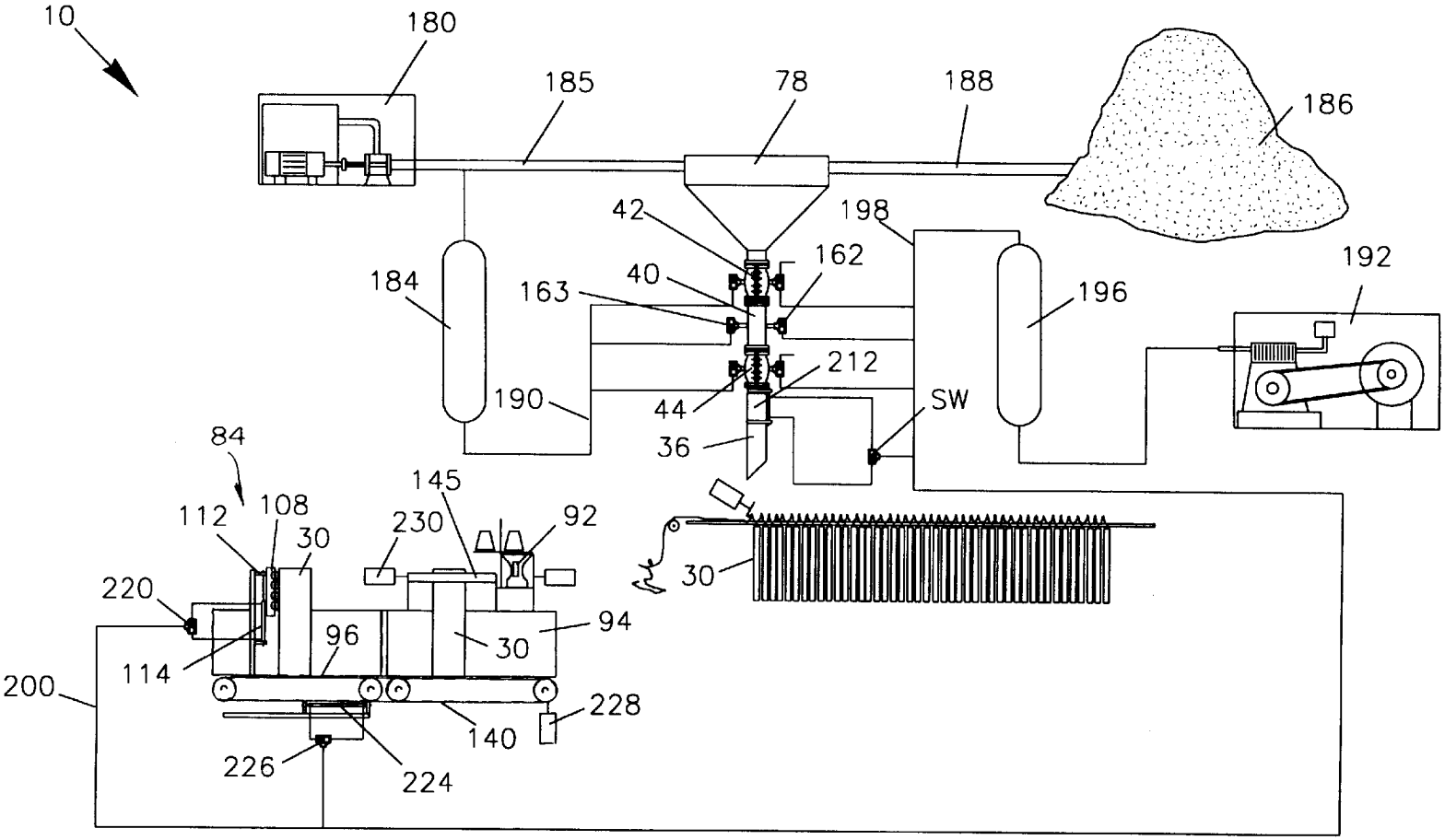
FIG. 15 is a system schematic view of the sand bagging system of the present invention.

In FIG. 15, the sand bagging apparatus 10 is illustrated schematically. A vacuum pump 180 operates in conjunction with a vacuum tank 184 to provide a vacuum through a main vacuum line 185 in sand hopper 78, to draw sand 186 to a sand vacuum hose 188 into sand hopper 78. A vacuum is also provided at charge tube 40 through tube vacuum line 190. Vacuum pump 180 is a 60 ton/hour vacuum transport system made by DeMarco MAXVAC Corporation, Bensenville, Ill., U.S.A. or Guzzler Model S7000AE industrial vacuum loader powered by Caterpillar 3406 auxiliary engine manufactured by Federal Signal Industrial Vacuum Division of Birmingham, Ala., U.S.A.

In the preferred embodiment, a screw conveyer is used in place of sand vacuum hose 188. The configuration is as depicted in FIG. 15, except that the vacuum tank 184 is evacuated by a vacuum connection on an air compressor 192, which is expected to be adequate for operating charge tube 40 and other vacuum accessories.

Alternatively, a smaller version of vacuum pump 180 could be provided, although not connected to the sand hopper 108 because the screw conveyer does not require vacuum to move the sand 186.

If a screw conveyer or other solid material transport system is used instead of sand vacuum hose 188, it is also possible to eliminate the vacuum supply and rely solely on compressed air or other fluid to operate the various components, including hopper valve 42, discharge valve 44, charge tube 40, and the actuator cylinders such as actuator cylinder 114.

The sand 186 can be any form of aggregate or powdered solid or semi-solid material, the only criteria being that it is suitable for the purpose and that the various components be able to negotiate the material.

The air compressor 192 operates in conjunction with a compressed air tank 196 to provide a source of compressed air, through line 198 to charge tube 40, and through line 200 to a set of linear pneumatic motors, discussed later. Air compressor 192 is a Quincy Northwest Model QNW-F20 single stage, heavy duty air cooled, oil-flooded rotary screw air compressor, mounted on a 120 gallon, horizontal air receiver, 73 SCFM capacity at 125 PSIG, nominal rating 20 HP.

To withdraw a charge of sand from hopper 78 and dump the charge of sand into a sand bag 30, hopper valve 42 is opened by drawing a vacuum from vacuum tank 184, and releasing (venting) pressure from compressed air line from compressed air tank 196; and fill valve 44 is closed by introducing compressed air from compressed air tank 196. Charge tube 40 first is evacuated by opening valve 163, connecting charge tube 40 with vacuum tank 184. Valve 163 is then closed and hopper valve 42 opened, to immediately draw a charge of sand into charge tube 40 from sand hopper 78. Hopper valve 42 is then closed and valve 162 opened to bring compressed air into charge tube 40. Fill valve 44 is then opened (with the fill tube lowered into a sand bag), and a charge of sand is immediately forced down the charge chute and fill tube 36 into a sand bag 30. Fill valve 44 is then closed and the process repeated to withdraw the next charge of sand from hopper 78.

A second actuator cylinder 212 is connected to fill tube 36. A switching valve 214 controls delivery of compressed air from line 200 to and from the working chambers of the second actuator cylinder 212. The second actuator cylinder 212 operates to raise and lower fill tube 36.

A switching valve 220 controls the flow of compressed air pressure from line 200 into and out of the working chambers of the first actuator cylinder 114. The first actuator cylinder 114 carries rollers 108, of bag former 84.

A third actuator cylinder 224 is connected to the bottom conveyor 96 of bag former 84. A switching valve 226 controls the flow of air pressure to and from the working chambers of the third actuator cylinder 224. The third actuator cylinder 224 moves conveyor belt 96 back and forth to discharge a sand bag 30 from bag former 84.

One of the sewing machines 92 and its associated conveyors 94, 140 are shown to the right of bag former 84. A similar sewing machine and conveyor is located to the left of bag former 84, but, for clarity, is not shown. This second sewing machine is identical to the one shown.

An electric motor 228 runs bottom conveyor 140, and another electric motor 230 runs the small belts in feeder 145 and side conveyors 94. Conveyors 94, 140 and feeder 145 run continuously as they receive a sand bag 30 from bag former 84. Conveyors 94, 140 and 145 move sand bag 30 through sewing machine 92, and then 94 and 140 discharge sand bag 30 laterally from the sand bagging apparatus 10.

FIGS. 16*a* through 27*a* and FIGS. 16*b* through 27*b* illustrate the sequence of operation in filling a bag with sand, sewing the bag shut, and discharging the bag from the apparatus. Each FIG. 16*a* through 27*b* includes a front view of the system, and each FIG. 15*a* through 26*b* includes a corresponding side view of the bag former and charging device.

Figure 16B:
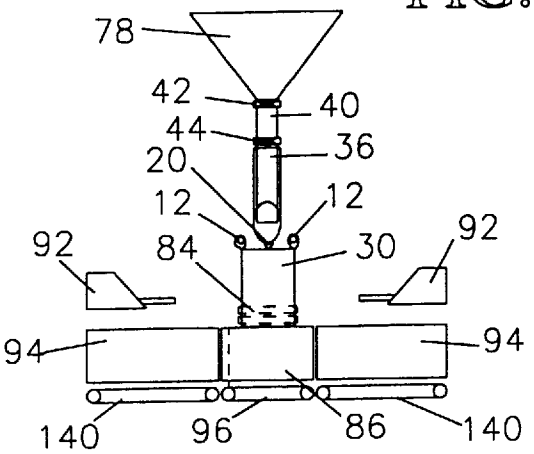
Figure 16A:
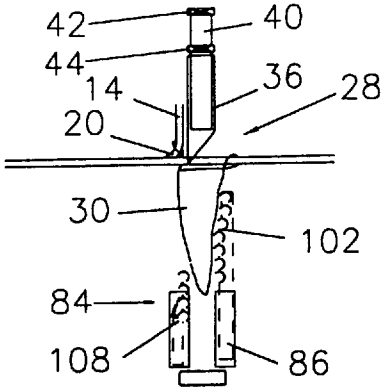

In FIGS. 16*a* and 16*b*, valve 42 is opened and valve 44 is closed, which causes the fill tube 36 to fill with a charge of sand. Fill tube 36 is raised and a sand bag 30 is at the charging station 28 with its center tab 20 held on center rail 14, thus opening bag 30. Rollers 108 are in a lowered position, which allows the lower end of bag 30 to travel past rollers 108 and up to rollers 102. Bottom conveyor 96 and side conveyors 86 is positioned by their motor to receive a bag and discharge it to the right.

Figure 17B:
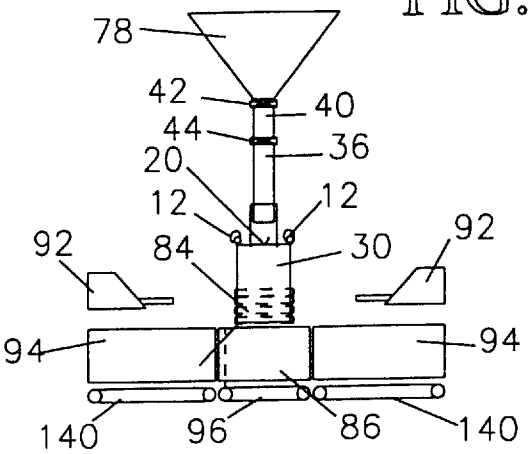
Figure 17A:
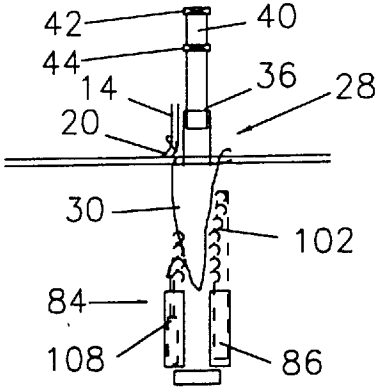
Figure 18B:
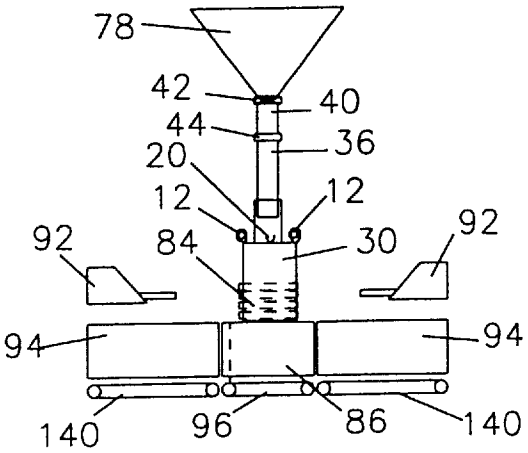
Figure 18A:
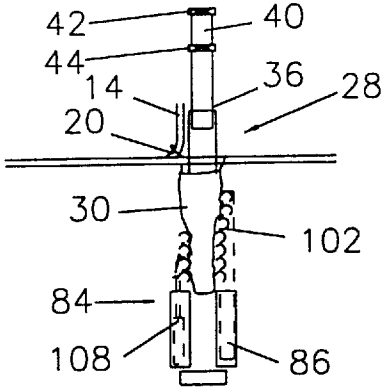

In FIGS. 17, fill tube 36 is lowered into sand bag 30. Rollers 108 are raised into their upper position so that the sand bag 30 is between rollers 108 and rollers 102. In FIGS. 18, the compressed air is introduced into charge tube 40, valve 44 is opened, and a charge of sand is dumped into sand bag 30.

Figure 19B:
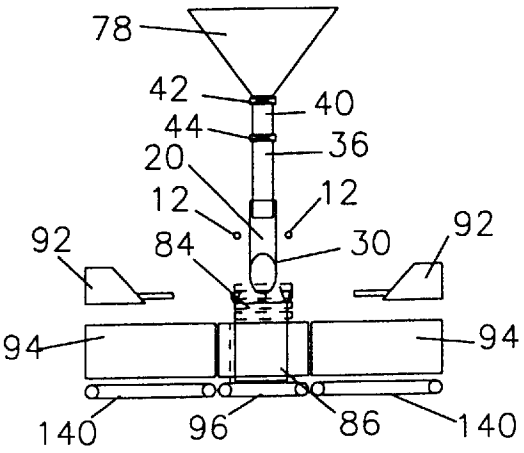
Figure 19A:
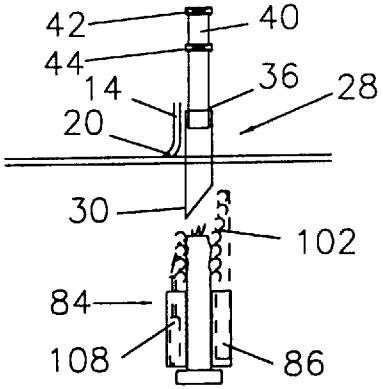

In FIGS. 19, valve 44 closes and the tab cutters (not shown) are activated to cut tabs 18, 20, allowing sand bag 30 to drop into bag former 84.

Figure 21B:
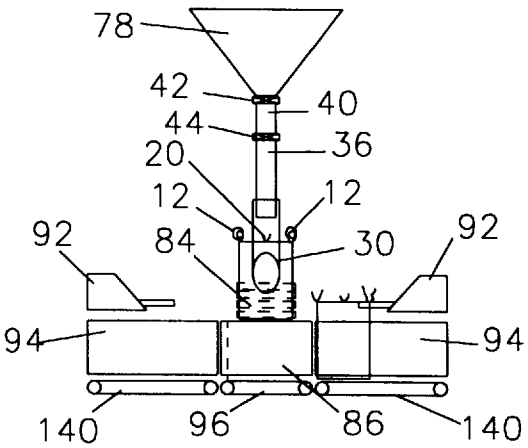
Figure 21A:
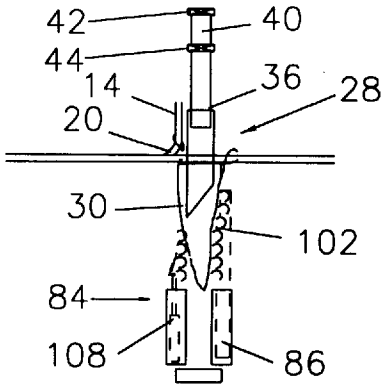
Figure 20B:
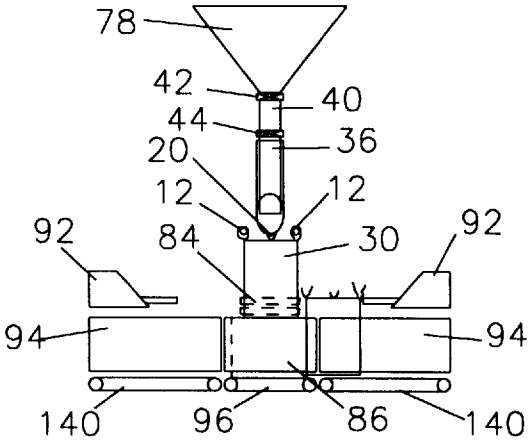
Figure 20A:
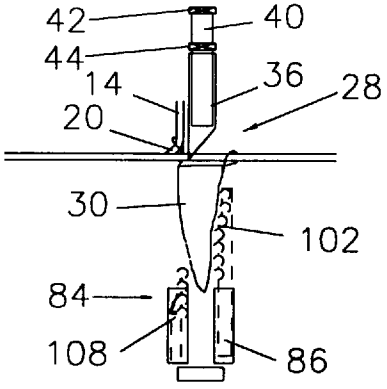
Figure 25B:
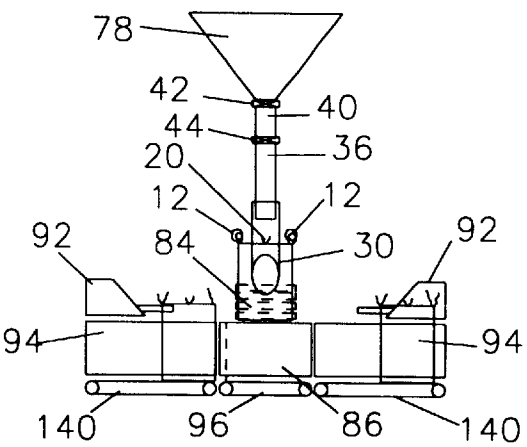
Figure 25A:
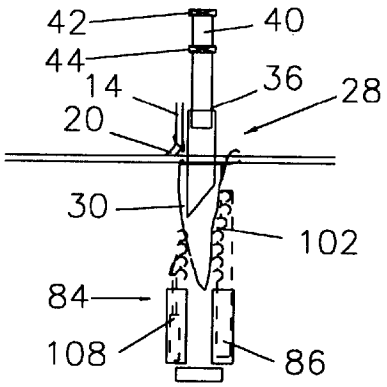
Figure 24B:
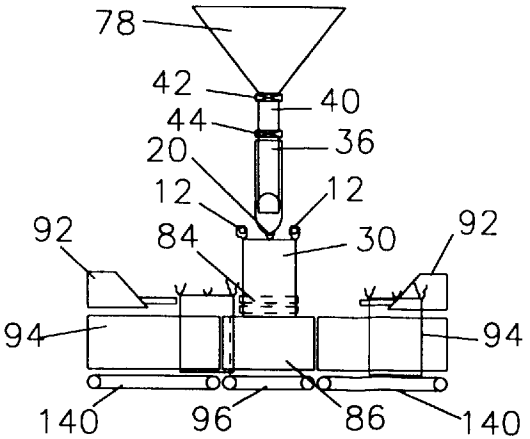
Figure 24A:
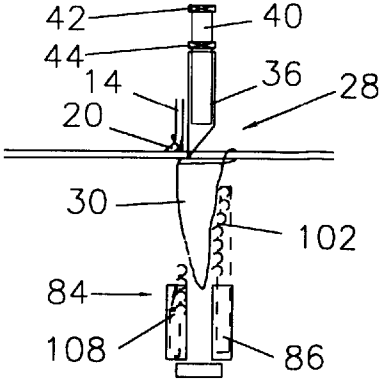
Figure 27B:
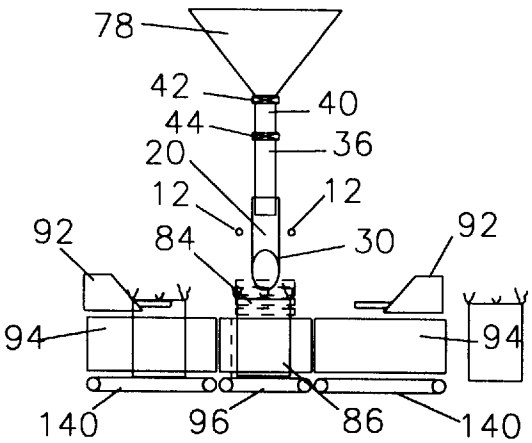
Figure 27A:
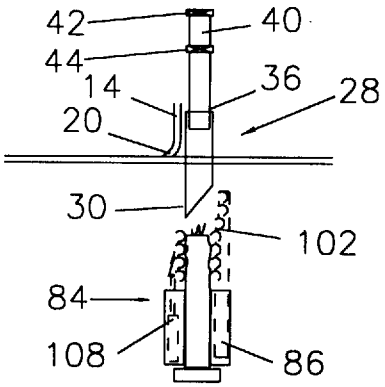

In FIGS. 20, charge tube 40 is evacuated and valve 42 opened to withdraw a charge of sand into charge tube 40. Fill tube 36 is raised and conveyors 96, 86, 140, 94 move sand bag 30 to the right as shown. The next sand bag is moved into the charging station 28 and is opened to receive fill tube 36 in the manner previously discussed. In FIGS. 21, valve 42 closes, fill tube 36 moves down, rollers 108 are raised. In FIGS. 22, compressed air is introduced into charge tube 40 and valve 44 opens to discharge sand into sand bag 30. Sand bag 30 continues to move to the right and its upper portions move between guide bars 144 toward sewing machine 92. In FIGS. 23, valve 42 is closed and charge tube 40 is evacuated. The tab cutters are activated to sever the tabs of sand bag 30, allowing it to fall into bag former 84. In FIGS. 24, charge tube 40 is evacuated and valve 42 opened to withdraw another charge of sand into charge tube 40. Fill tube 36 is raised and rollers 108 are lowered so that the next sand bag 30 can move into charging station 28. The sewing machine 92 to the right is operated to begin sewing the upper regions of sand bag 30, and the conveyors of bag former 84 and the conveyors associated with the left sewing machine are operated to move sand bag 30 to the left out of bag former 84. In FIGS. 25, valve 42 is closed and compressed air is introduced into charge tube 40. Fill tube 36 is lowered and rollers 108 are raised.

Figure 26B:
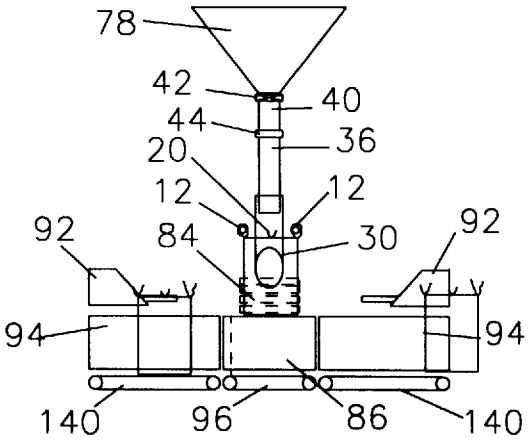
Figure 26A:
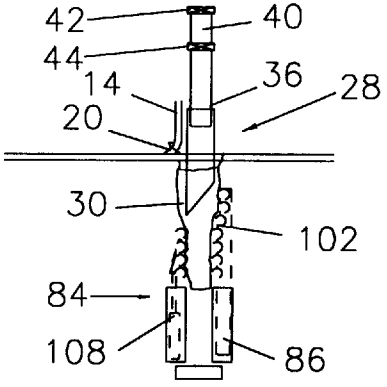

In FIGS. 26, valve 44 is opened and a charge of sand is introduced into sand bag 30. The second sand bag 30 is moved through the guide bars 144 and sand bag 30 is stitched shut and laterally discharged from the apparatus. In FIGS. 27, valve 44 is closed and charged tube 40 is evacuated. The tab cutters are activated to sever sand bag 30 from charging station 28 down into bag former 84. Sand bag 30 moves into its sewing machine and its upper regions are stitched. The conveyors associated with bag former 84 are reversed to move sand bag 30 to the right toward to the sewing machine that just finished stitching sand bag 30.

Figure 28:
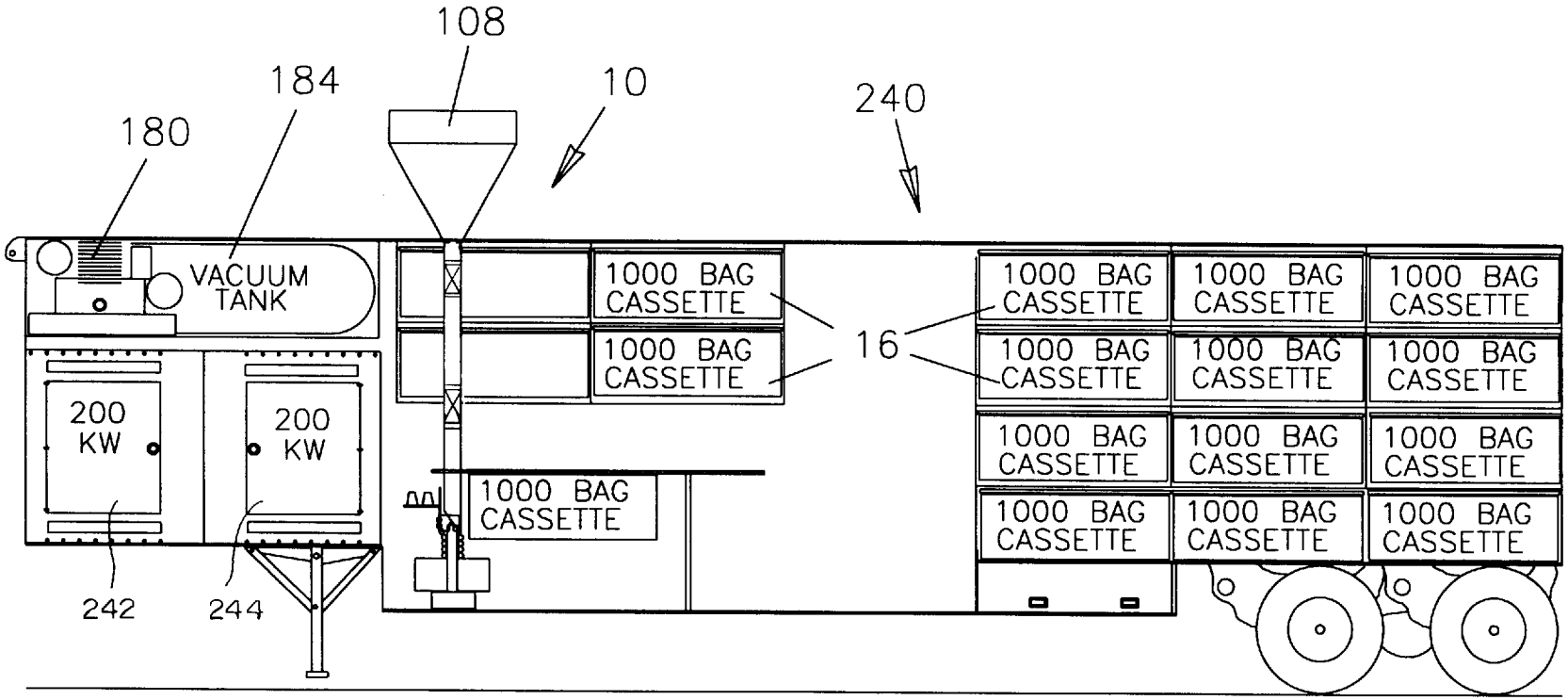
FIG. 28 is a side view of a trailer rig with its side panels cut away to show the sand bagging system of the present invention mounted within the trailer.

FIG. 28 is a schematic side view of a semi-trailer 240, in which the present invention can be installed, along with a plurality of sand bag cassettes 16. The sand bagging apparatus 10 is installed in the front half of trailer 240, just behind an engine 242, a generator 244 and a vacuum pump 180 tank 184. Engine 242 and generator 244 provide power to the various motors and pumps discussed previously, and are components generally known in the art.

Figure 30A:
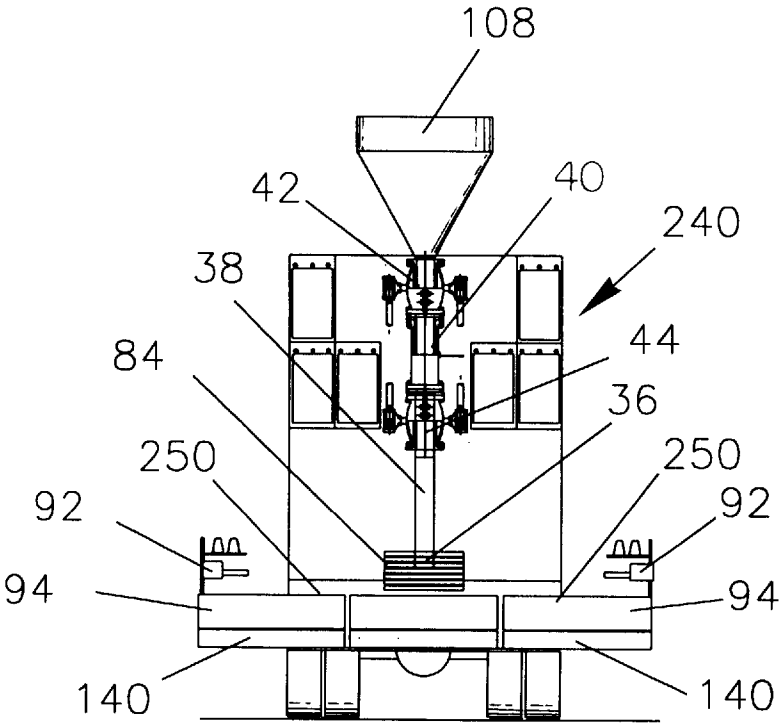
FIGS. 29–31 are a series of end views of the trailer rig of FIG. 28.
Figure 29:
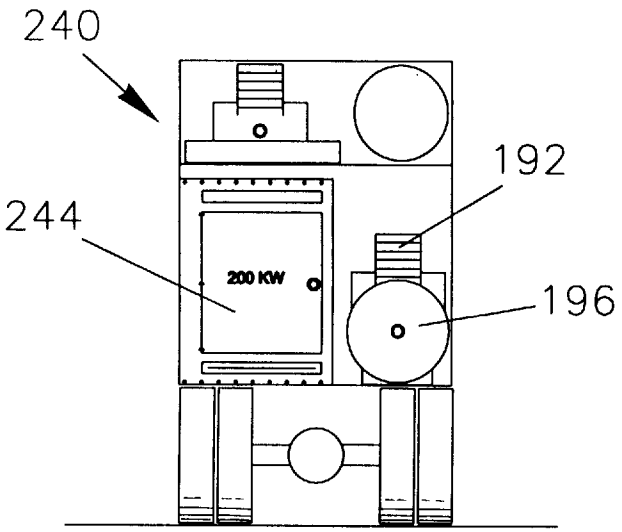
Figure 31:
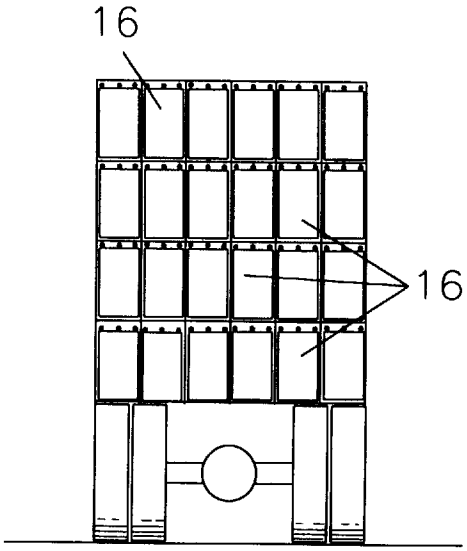

FIGS. 29–31 are views of the trailer of FIG. 28, looking forward at different station locations along the length of the trailer 240. A generator 244 rests adjacent the air compressor 192 and tank 196.

Figure 30B:
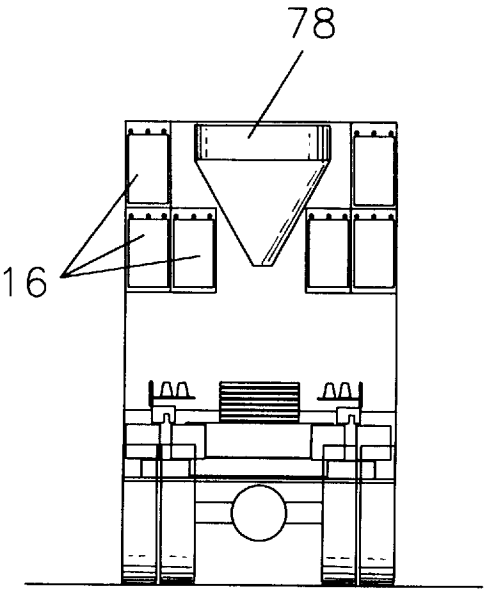

FIGS. 30*a* and 30*b* is a view of the sand bagging apparatus 10 mounted within trailer 240 and shown in an assembled configuration. Hopper valve 42 and fill valve 44 are shown on charge tube 38 in their respective positions. Bag former 84 is shown below charge tube 38 and between sewing machines 92. In operation, bag cassettes 16 are manually loaded onto the rails (not shown) of the system and their tension ribbons are fed through the tension rollers to place the cassette in position for operation. As shown in FIG. 30*a*, side openings 250 are provided at the sides of trailer 240 to receive laterally extendable conveyors 94, 140. With conveyors 94, 140 extended beyond the side walls of trailer 240, sand bags will be discharged laterally from trailer 240, either onto the ground or any suitable receptacle, vehicle or secondary conveyor. As shown in FIG. 30*b*, hopper 78 and charge tube 38 and charge chamber 40 can be disassembled to mount within trailer 240. Therefore, these elements are not shown in FIG. 30*b*. Additionally, conveyors 94, 140 and sewing machines 92, likewise, can be reconfigured into trailer 240 for transport.

FIG. 31 shows how trailer 240 can carry a plurality of bag cassettes 16, which can provide for thousands of sand bags in just one trailer. Additional trailers can be loaded with bag cassettes only, if necessary, and have their cassettes loaded onto rails 12 of sand bagging apparatus 10.

Figure 32B:
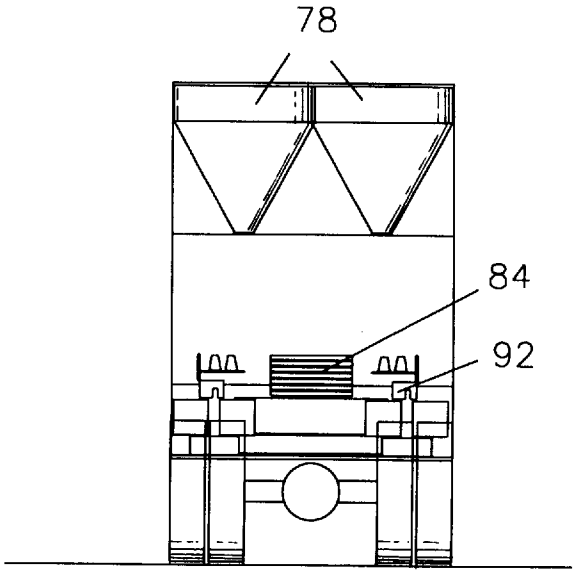
FIGS. 32*a* and 32*b* are end views of an alternative double loading system, in operational and folded configurations, respectively.
Figure 32A:
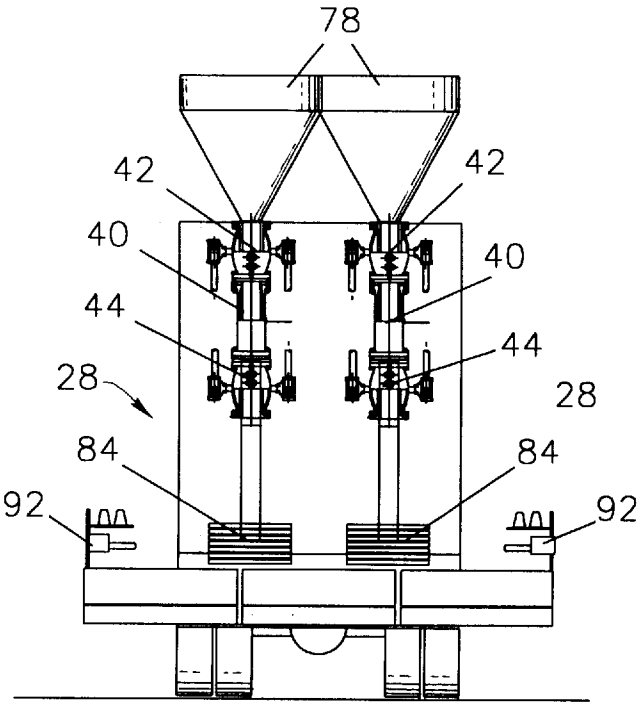

FIGS. 32*a* and 32*b* show an alternative arrangement where a pair of bag forming and charging stations 28 are provided. This arrangement includes a pair of hoppers 78, a pair of pinch valves 42, 44 for each charge chamber 40. Two bag forming stations 84 are provided, but each station 84 is associated with a single sewing machine 92. The bags are discharged in either of two directions—left or right—with the ability to be angularly directed to either of two sewing machines (not shown). This arrangement provides a greater rate of bag charging.

Figure 33:
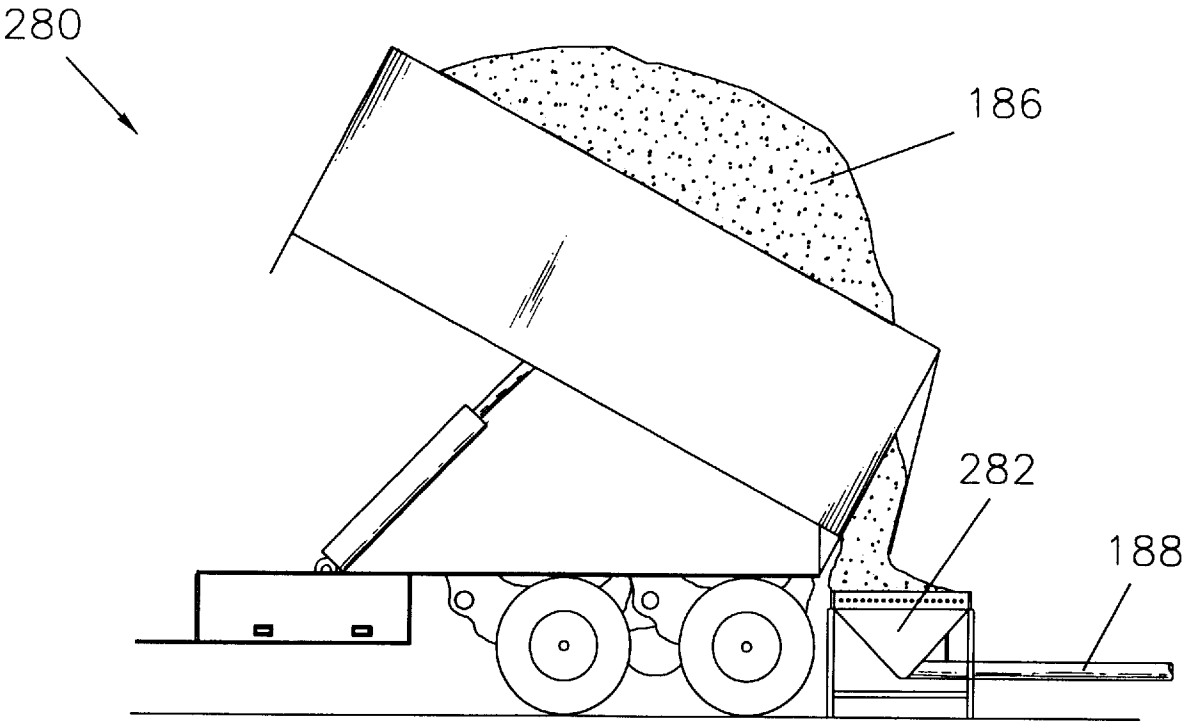
FIG. 33 is a schematic view of a sand truck loading sand into a hopper for delivery to the sand bagging system of the present invention.

FIG. 33 shows a sand truck 280 loading sand 186 into a grizzly 282, which is connected to sand vacuum hose 188. Other arrangements can be utilized for delivering sand 186 into the hoppers of the system, such as the screw conveyer anticipated for the preferred embodiment.

Figure 34:
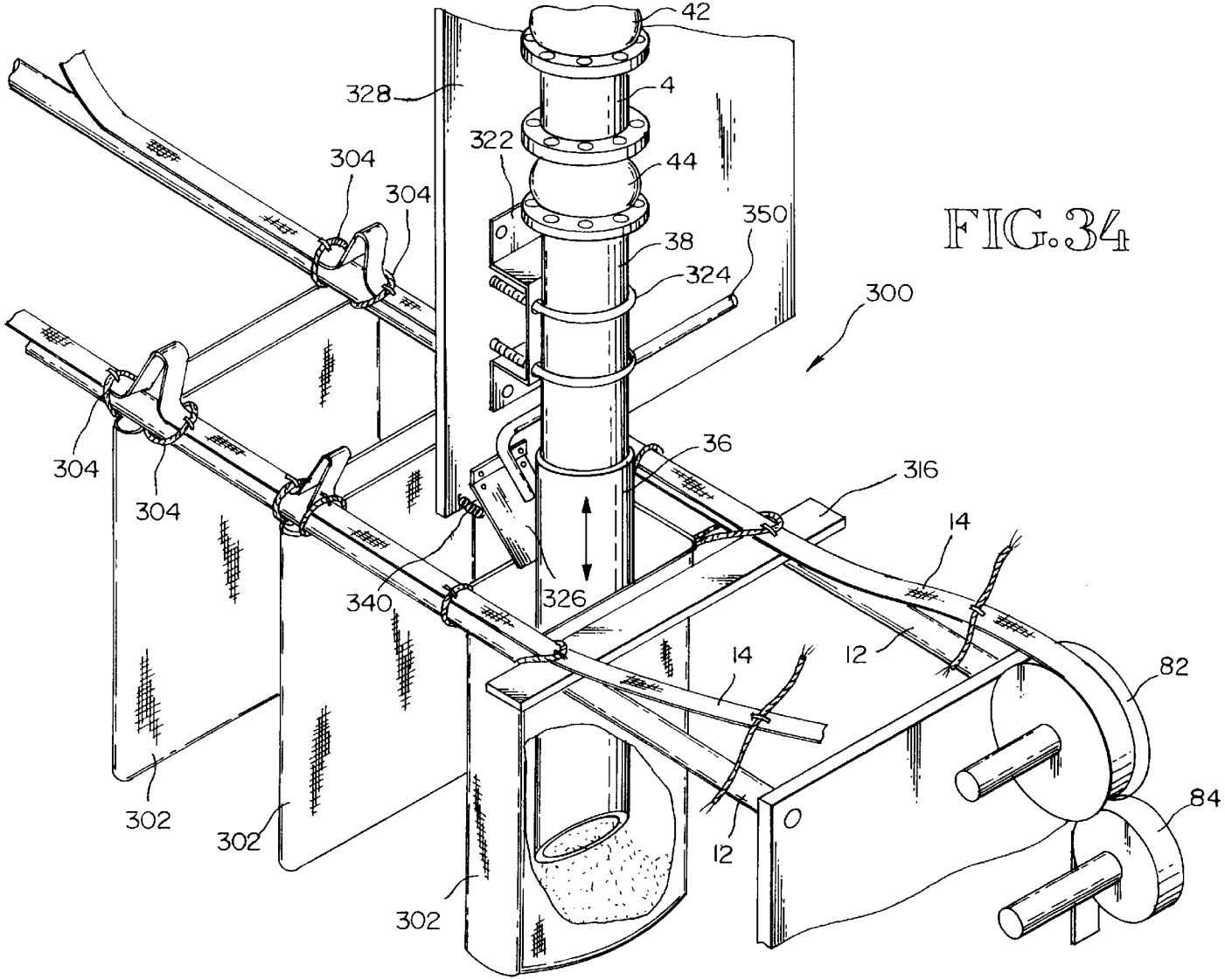
FIG. 34 is a view like FIG. 1 of an alternative embodiment of the sand bagging system of the present invention, in which two rails are used to convey the bags.

FIG. 34 illustrates an alternative embodiment of a sand bagging apparatus 300. The center rail 14 of FIG. 1 is eliminated, and each bag 302 is secured to ribbons 22 by four tabs 304, two at each side of each bag 302. A pair of ribbon-tension wheels 311, 312 provide tension for ribbon 22. Motors (not shown) drive wheels 66, 67 in opposite directions to generate the necessary tension in the manner described in connection with FIG. 1. A bag stop bar 316 is mounted atop rails 12. Bag stop 316 prevents advancement of the leading bag 302 beyond charging station 28.

A bag opening device is secured to charge tube 38 by a bracket 322 and a pair of bands 324. A plate 326 is hinged to an elongated upright back panel 328, which is fixed to the bracket 322. A coil spring 340 is secured at one end to panel 328 and at its other end to plate 326, to bias plate 326 outwardly toward fill tube 36.

A compressed air tube 350 leads from a source of compressed air (not shown) to a point above plate 326. Directed compressed air from tube 350 causes plate 326 to pivot downwardly against the resistance of coil spring 340 in a manner that engages an upper side edge of bag 302 to open the bag. Plate 326, in conjunction with bag stop 316, effectively replaces the center rail of the first embodiment shown in FIG. 1.

What is claimed is:

1. A method of bagging bulk material, comprising:

providing a plurality of bags, each having a closed lower end, an openable upper end, a leading side and a trailing side;

connecting the bags in series to at least one elongated tension member that extends perpendicular to the leading and trailing sides of the bags;

moving the bags in succession to a charging station, leading side first, by pulling on the elongated tension member, said leading and trailing sides of each bag being contiguous each other as they move towards the charging station;

positioning a lead bag at the charging station;

opening the top of the lead bag;

collecting a measured charge of bulk material at the charging station in a charge tube;

discharging bulk material through the charge tube into the open top of the lead bag while such bag is at the charging station;

closing the lead bag after discharging the measured charge of bulk material into the open top of the lead bag;

severing the connection of the lead bag to the elongated tension member;

moving the lead bag away from the charging station after discharging the bulk material into the lead bag at the charging station; and moving the next bag in succession to a lead position at the charging station for receiving bulk material from the charge tube.

2. The method of claim 1, further comprising supporting the lead bag at the charging station by a bottom support while discharging the bulk material into the lead bag.

3. The method of claim 1, further comprising supporting the sides of the lead bag while discharging the bulk material into the lead bag, to limit sideways expansion of the lead bag while it is receiving the bulk material.

4. The method of claim 1, further comprising connecting additional bags to the elongated tension member following some movement of the elongated tension member.

5. The method of claim 4, further comprising providing a pair of laterally spaced apart elongated tension members and connecting upper corner regions of the bags to said tension members.

6. The method of claim 1, further comprising providing a pair of laterally spaced apart side rails, and providing bag hangers on upper corner regions of the bags which engage the side rails and support the bags for movement along the side rails, whereby a pull on the elongated tension member will pull the bags along the side rails to the charging station.

7. The method of claim 1, further comprising providing a center guide rail which terminates short of the charging station and includes an upwardly extending terminus portion, and providing each bag with a member on the trailing side of the bag that engages the center guide rail, and moves along the center guide rail in response to movement of the bags to the charging station, and using the upwardly extending terminus portion to engage the member on the trailing side while the bag is at the charging station, to resist further forward movement of the trailing side of the bag, and moving other portions of the bag forwardly while its trailing side is held, for opening the bag so that it can receive the charge of bulk material.

8. The method of claim 1, further comprising providing a pair of laterally spaced apart side rails, and providing bag hangers on upper corner regions of the bags which engage the side rails and support the bags for movement along the side rails, providing a pair of laterally spaced apart elongated tension members and connecting upper corner regions of the bags to said tension members, whereby a pull on the elongated tension members will pull the bags along the side rails to the charging station.

9. The method of claim 1, further comprising providing a pair of laterally spaced apart elongated tension members, connecting upper corner regions of the bags to the tension members by use of connector members, and using a cutter for severing the connector members on the lead bag after the discharge of bulk material into the lead bag.

10. The method of claim 1, comprising collecting the bulk material by using first and second valves and a charge chamber, said first valve being positioned above the charge chamber and the charge chamber being positioned above the second valve, closing the second valve and opening the first valve to allow a charge of the bulk material to enter the charge chamber, and subsequently closing the first valve and opening the second valve to deliver the charge of bulk material from the charge chamber to the bag that is at the charging station.

11. The method of claim 10, further comprising controlling the amount of bulk material in a charge of bulk material by sequencing the opening and closing of the first and second valves.

12. The method of claim 10, further comprising using compressed air to agitate the bulk material as the bulk material enters the charge chamber, thereby facilitating flow of the bulk material into the charge chamber.

13. A bagging system, comprising:

means for supporting a series of bags for movement of the bags in succession to and from a charging station, said bags having leading and trailing sides that are perpendicular to the direction of bag movement, said leading and trailing sides of each bag being contiguous each other during movement of the bag to the charging station;

a charge tube at the charging station that is aligned with each bag that is positioned at the charging station;

metering means for measuring a charge of bulk material and delivering the charge into the charge tube;

material transfer means for discharging the measured bulk material from the charge tube into a bag positioned at the charging station;

bag closing means for closing each bag after it has been filled with a charge of bulk material; and a means for moving each filled bag away from the charging station and for moving the next bag to the charging station.

14. The bagging system of claim 13, further including a bottom support for supporting the bottom of the bag that is at the charging station during the discharge of the charge of bulk material into the bag.

15. The bagging system of claim 13, further comprising side supports at the charging station positioned to contact and support the sides of the bag that is at the charging station to prevent it from expanding laterally beyond a predetermined amount while it is receiving a charge of bulk material.

16. The bagging system of claim 13, wherein the means for supporting the series of bags comprises a pair of laterally spaced apart side rails and members at the upper corners of the bag which engaged the side rails and are slidable along the side rails.

17. The bagging system of claim 16, comprising a pair of laterally spaced apart elongated tension members, one associated with each side rail, and connector means connecting the upper corner regions of the bags to the elongated tension members.

18. The bagging system of claim 17, wherein the connector members at the upper corner regions of the bags are loops and said loops are connected to the tension members.

19. The bagging system according to claim 13, wherein the metering means comprises a charge chamber in the charge tube, a first valve above the charge chamber and a second valve below the charge chamber, whereby the first valve can be opened when the second valve is closed, to allow a charge of the bulk material to enter the charge chamber, and then the first valve can be closed and the second valve opened, to deliver the charge of bulk material from the charge chamber into a bag that is at the charging station.

20. The bagging system of claim 19, wherein the charge chamber has an adjustable volume.

21. The bagging system of claim 19, comprising a compressed air source and a nozzle connected to the compressed air source and positioned to discharge compressed air into the bulk material as the bulk material enters the charge chamber, thereby increasing flow of the bulk material into the charge chamber.

22. A bagging system, comprising:

a plurality of bags attached together in series, said bag each having an openable top, a closed bottom, a leading side and a trailing side;

a bag positioning mechanism including a pair of laterally spaced apart side rails and a center rail between the side rails;

elongated tension members attached to the bags and adapted to be moved longitudinally for moving the bags along the rails;

said center rail terminating before the charging station as a upwardly extending hook;

each bag including a member attached to its trailing side that is adapted to engage said hook, so that said hook will hold the trailing side of the bag while the leading side of the bag is moved forwardly, to in that manner open the top of the bag;

a charge tube at the charging station that is alignable with the open top of a bag at the charging station;

a charge metering device for measuring a charge of bulk material and delivering the charge into the charge tube;

a material transfer device for discharging the bulk material from the charge tube into an open bag positioned at the charging station;

a bag closing mechanism for closing each bag at the charging station after it has received a charge of the bulk material; and a bag discharge mechanism for removing each filled and closed bag from the charging station.

23. The bagging system of claim 22, further comprising a cutter for severing the attachment of the bags to the elongated tension members after the bag is filled with bulk material at the charging station.

24. The bagging system of claim 23, further comprising a lateral discharge shuttle positioned beneath the charging station for receiving a bag after the attachment of the bag to the elongated tension members is severed, and adapted for laterally discharging the bag.

25. The bagging system of claim 24, wherein the discharge shuttle includes a pair of carriages for alternately receiving a bag from the charging station and discharging the bag laterally, wherein one carriage discharges a bag in a first lateral direction while the other carriage receives a bag, and then the other carriage discharges its bag in the opposite lateral direction while the first carriage receives a new bag.

26. The bagging system of claim 25, further comprising at least one sewing machine positioned for sewing closed the open end of a bag after the bag has received a charge of the bulk material.

27. A method of bagging bulk material, comprising:

providing a plurality of bags, each having a leading side, a trailing side, a closed lower end, and an openable upper end;

moving the bags in succession to a charging station, leading side first;

providing a charge tube at the charging station that has a downwardly directed discharge opening;

positioning the lead bag at the charging station, below the charge tube;

providing a bag restraint rearwardly adjacent the charging station, said bag restraint including an upwardly extending member;

using the upwardly extending member to engage a trailing portion of the lead bag while it is at the charging station, to restrain forward movement of the trailing portion of the bag;

opening the lead bag that is at the charging station by moving other portions of the bag forwardly, away from the trailing side of the bag;

collecting a measured amount of bulk material in the charge tube;

discharging the measured amount of bulk material out from the charge tube into the open lead bag that is at the charging station;

closing said lead bag after discharging the measured amount of bulk material into the lead bag; and moving the lead bag away from the charging station and moving the next bag in succession to the charging station.

28. The method of claim 27, further comprising providing a pair of laterally spaced apart side rails, and providing bag hangers on the bags which engage the side rails and support the bags for movement along the side rails, and providing a pair of elongated tensions members, each positioned to extend generally along one of the side rails, and providing bag hangers on upper corner regions of the bags which engage the side rails and support the bags for movement along the side rails, and connecting upper corner regions of the bags to said tension members, whereby a pull on the elongated tension members will pull the bags along the side rails to the charging station.

29. The method of claim 28, further comprising providing a center guide rail which terminates rearwardly adjacent the charging station, wherein the said bag restraint is a terminus portion of the center guide rail, and providing the trailing side of each bag with a member that engages the center guide rail and moves along the center guide rail in response to movement of the bags to the charging station, and using said bag restraint to engage the connector member on the trailing side of each bag while such bag is at the charging station, to resist further forward movement of the trailing side of the bag, and pulling on the elongated tension members to pull on the upper corner regions of the bags, for moving them forwardly away from the restrained trailing side of the bag, to in that manner open the top of the bag.

* * * * *